US006023593A

United States Patent [19]

Tomidokoro

[11] Patent Number: 6,023,593

[45] Date of Patent: Feb. 8, 2000

[54] CONSUMABLE ITEM SUPPLYING SYSTEM FOR AN IMAGE FORMING APPARATUS

[75] Inventor: Nobuaki Tomidokoro, Yokohama, Japan

[73] Assignee: Ricoh Company, Ltd., Tokyo, Japan

[21] Appl. No.: 09/094,474

[22] Filed: Jun. 10, 1998

[30] Foreign Application Priority Data

Jun. 10, 1997 [JP] Japan ..... 9-168189

[51] Int. Cl.[7] ..... G03G 21/00; G03G 15/00

[52] U.S. Cl. ..... 399/8; 399/24; 399/81

[58] Field of Search ..... 399/1, 8, 81, 24; 705/28

[56] References Cited

U.S. PATENT DOCUMENTS

| | | | |
|---|---|---|---|
| 5,305,199 | 4/1994 | LoBiondo et al. | 395/228 |
| 5,335,048 | 8/1994 | Takano et al. | 399/8 |
| 5,434,650 | 7/1995 | Nakahara et al. | 399/8 |
| 5,638,427 | 6/1997 | Flemming et al. | 379/93.17 |

FOREIGN PATENT DOCUMENTS

| | | |
|---|---|---|
| 8-152814 | 6/1996 | Japan . |
| 8-152824 | 6/1996 | Japan . |

*Primary Examiner*—Joan Pendegrass
*Attorney, Agent, or Firm*—Oblon, Spivak, McClelland, Maier & Neustadt, P.C.

[57] ABSTRACT

A consumable item supplying system includes a plurality of image forming apparatuses each using a plurality of consumable items, for example, copysheets, toner, and so on. The consumable item supplying system includes a consumable item manual requesting operation for manually requesting a consumable item from each of the image forming apparatuses. A central controller orders a consumable item from a consumable item supplier or the like when the consumable item is requested from one of the image forming apparatuses, and a data communication device can receive data representing a consumable item request by polling each of the image forming apparatuses and sending the polling results from the image forming apparatus to the central controller.

25 Claims, 22 Drawing Sheets

| PROCESS CODE (A) | | INFORMATION CODE (B) | DATA PORTION DIGIT | DATA | | |
|---|---|---|---|---|---|---|
| 33 | ; | 350000101000 | 01 | 1 | | (B) CONSUMABLE ITEM REQUEST |
| | ; | 160800101000 | 02 | 01 | (C) | A3 PAPER, 1 PACK |
| | ; | 160800102000 | 02 | 00 | (C) | A4 PAPER, 0 PACK |
| | ; | 160800103000 | 02 | 00 | (C) | A5 PAPER, 0 PACK |
| | ; | 160800104000 | 02 | 00 | (C) | B4 PAPER, 0 PACK |
| | ; | 160800105000 | 02 | 02 | (C) | B5 PAPER, 2 PACKS |
| | ; | 160800106000 | 02 | 00 | (C) | B6 PAPER, 0 PACK |
| | ; | 160800131000 | 02 | 01 | (C) | OHP SHEET(A3), 1 PACK |
| | ; | 160800132000 | 02 | 00 | (C) | OHP SHEET(A4), 0 PACK |
| | ; | 160800191000 | 02 | 00 | (C) | TONER, 0 BOTTLE |
| | ; | 160800192000 | 02 | 02 | ETX | STAPLE, 2 PACKS |

*FIG. 20*

| PROCESS CODE (A) | | INFORMATION CODE (B) | DATA PORTION DIGIT | DATA (C) | |
|---|---|---|---|---|---|
| 04 | ; | 510800101000 | 06 | 970307 | ETX |

SCHEDULED DELIVERY DATE = MARCH 7, 1997
(DATA FOR ORDERED IS FFFFFF)

*FIG. 21*

FIG. 22

| CODE | PROCESS NAME | CONTENT |
|---|---|---|
| 30 | SC Call | Auto Call When SC problem Occures |
| 31 | Manual Call | Auto Call When a Manual Switch is Depressed |
| 32 | Alarm Sending | Auto Alarm Call |
| 33 | Supply Request Call | Auto Call When a Supply Request SW is Dpressed |
| 22 | Block Billing | Auto Call When Block Billing is Counteded up |
| 02 | Data Reading | Reading Data stored inside of a PPC |
| 04 | Data Writing | Writing Data stored inside of a PPC |
| 03 | Excution | Test by Remote Control Manner |
| 08 | Device Cide Check | Check Communication Function |

FIG. 23

| Code | Data Length | Content |
|---|---|---|
| Information Code | 11 | representing a specific information kind |
| Figure of Data Part | 2 | representing data length of a following data part by an ASCII code ( 00, if no data par) |
| Data Part | changeable | Data corresponds to each information codes (no data in a field if the fugure of data part is 00) |

CONSUMABLE ITEM SUPPLYING SYSTEM FOR AN IMAGE FORMING APPARATUS

BACKGROUND OF THE INVENTION

1. Field of the Invention

The present invention relates to an image forming apparatus, and in particular, to a consumable item supplying system capable of supplying a consumable item from a consumable item supplying center under control of a central controlling apparatus connected with a plurality of image forming apparatuses when some consumable items are requested by the image forming apparatuses.

2. Discussion of the Background

In recent years, a variety of consumable item supplying systems have been proposed which include at least a central control apparatus for receiving a request for a consumable item from one of image forming apparatuses. The central control apparatus can order delivery of consumable items from a consumable item supplying center to the image forming apparatuses.

When the image forming apparatuses are copiers, such a consumable item supplying system generally has a function of sending a message including data indicating numbers of copysheets used or an amount of toner used, for example, from the copiers to the central control apparatus. Based on such a sent message, the consumable items, for example a copysheet or toner, to be used in the copiers are supplied at a predetermined timing from the consumable supplying center under control of the central control apparatus.

As illustrated in Japanese Laid Open patent Application Nos. 08-152814 and 08-152824, an amount of a consumable item remaining in an image forming apparatus is always monitored by a controller to avoid a shortage thereof, and such that a consumable item can be automatically supplied to the image forming apparatus when the consumable item remaining therein decreases to a predetermined number or amount.

However, in such background consumable item supplying systems, a copysheet having a toner image formed on one side thereof is sometimes reused to form a copy on the other side thereof, to thereby save natural resources. This results in that a total copy count counted by a copy counter of the image forming apparatus does not correspond to the amount of copy streets actually remaining in the copier. Accordingly, a request for supplying new copy sheets which is automatically made when copysheets remaining therein reach a predetermined amount is not precise in such background systems.

Further, if a large number of copysheets are to be copied at one copying operation, an amount of a predetermined sized copysheet may decrease to less than a predetermined amount during such a copying operation. However, a request for supplying new copysheets of the predetermined size is made only when the copysheets remaining therein reach the predetermined amount. This means that a request is not made before the copying operation of such a large number of copies is started. Therefore, the delivery of the new consumable item requested may be delayed, and an operator may have to stop the copying operation using such a consumable item until the requested consumable item is ordered and delivered.

SUMMARY OF THE INVENTION

As one feature, the present invention relates to a novel consumable item supplying system including a plurality of image forming apparatuses using consumable items, for example, a copysheet and so on. Such a consumable item supplying system includes a consumable item manual requesting device for manually requesting desired consumable items from the image forming apparatuses.

The novel consumable item supplying system can further include a data communication apparatus for receiving data representing the requested consumable item by polling each of image forming apparatuses, and communicating data to a central controller in response to the polling. The central controller can then order any needed consumable item from a consumable item supplying section when data representing a shortage of a consumable item is sent from the data communication apparatus. A memory can also be disposed in such an image forming apparatus for storing data representing a consumable item requested.

Further, the consumable item supplying system can include a display for displaying a delivery status of the requested consumable item and a delivery date.

Further, the consumable item supplying system can include a display for displaying a career of the consumable item having been requested to the central controller.

Further, the data communication apparatus can have functions of both polling and selecting for receiving data representing consumable items requested by each image forming apparatus, and sending data from the central control apparatus to a selected image forming apparatus.

Further, the consumable item request device can include a display capable of displaying messages indicating kinds of consumable items and messages for copying modes and so on, and for inputting consumable item amounts.

Further, the display can include a switch for changing messages from those for a copying mode to those for a consumable item request mode, and so on.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 20 shows text data included in a frame to be communicated between a copier and a central control apparatus when a consumable item is requested;

FIG. 21 shows text data representing a status of a delivery to be sent from a central control apparatus to a copier:

FIG. 22 is a table showing process codes, names of processes and contents of processes used as data to be communicated between a central control apparatus and a copier; and FIG. 23 is a table showing information codes, names of data and contents of data to be communicated between a central control apparatus and a copier.

PREFERRED EMBODIMENTS OF THE PRESENT INVENTION

Figure 1:
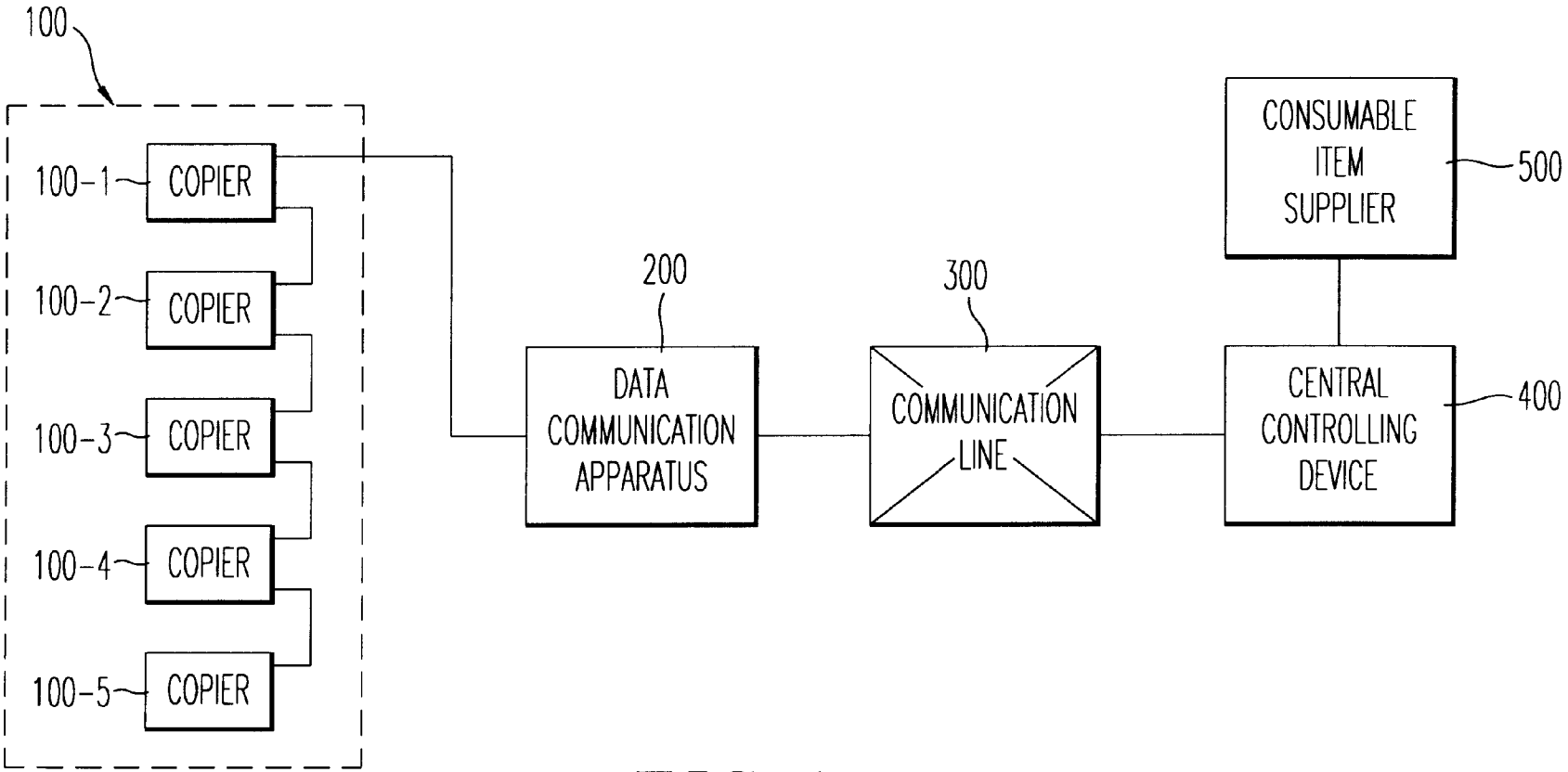
FIG. 1 is a block chart showing one consumable item supplying system of the present invention.

Hereinbelow, embodiments of the present invention are explained referring to the several drawings, wherein like reference numerals designate identical or corresponding parts throughout the several views.

Firstly, a consumable item supplying system for an image forming apparatus of the present invention is illustrated in FIG. 1 using a block chart. As illustrated in FIG. 1, the consumable item supplying system includes, as an example of an image forming apparatus, a copier group 100, a data communication apparatus 200, a communication line 300, a central control apparatus 400, and a consumable supplier 500. The copier group 100 includes a plurality of copiers 100-1, 100-2, 100-3, 100-4 and 100-5, for example.

The data communication apparatus 200 is connected to the communication line 300 and transfers text data, for example, sent from the central control apparatus 400 to the copier group 100, and transfers data generated by copies of the copier group 100 to the central control apparatus 400 each through the communication line 300. The data communication apparatus 200 can be operative all day, thereby enabling communication between the central control apparatus 400 and the copier group 100 even during a time when an electrical power of the copier group 100 is shut down. The data communication apparatus 200 can connect to a plurality of copiers 100-1 to 100-5 as illustrated in FIG. 1.

Each of the copiers of the copier group 100 and the data communication apparatus 200 can be connected in a state of a so called multi-drop connection as illustrated in FIG. 1 and data communications between the copier group 100 and data communication apparatus 200 can be executed using a serial data communications standard of RS-485, as an example. Further, the data communications therebetween can be executed by polling in which each of the copiers 100-1 to 100-5 is polled to determine whether data to be sent exists therein, and in which text data, for example, is transferred from the data communication apparatus 200 to the copier group 100.

Figure 2:
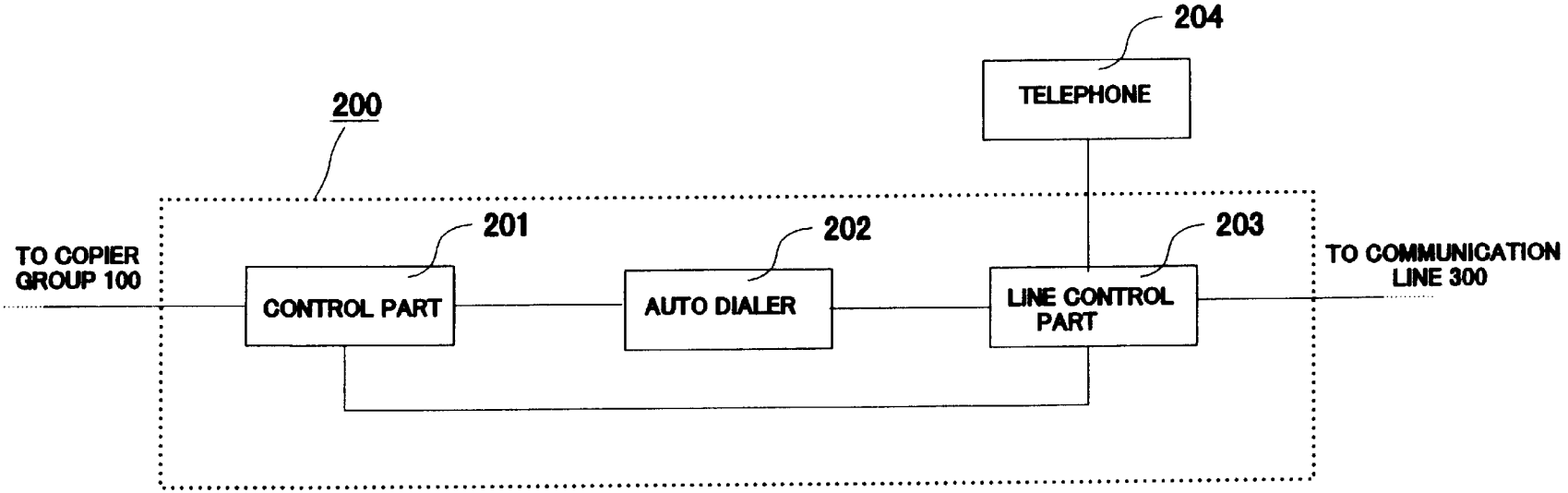
FIG. 2 is a block chart showing a detail of a data communication apparatus.

The data communication apparatus 200 is illustrated in detail in FIG. 2 using a block chart. As illustrated in FIG. 2, the data communication apparatus 200 includes a control part 201, an auto-dialer 202 for automatically dialing a number of the central control apparatus 400, and a line control part 203 for selectively connecting the communication line 300 with the copier group 100 or a telephone 204.

Figure 5:
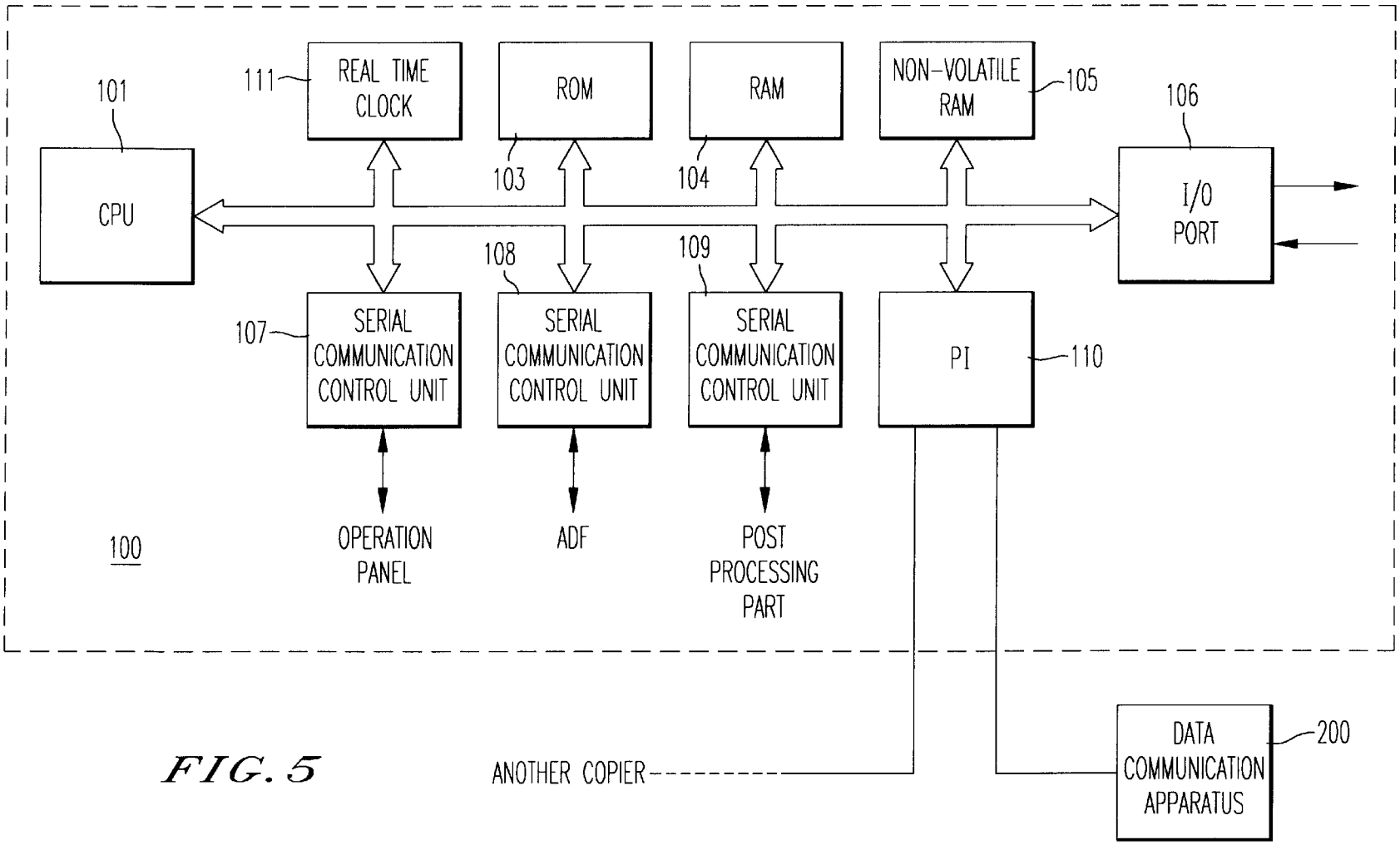
FIG. 5 is a block chart showing a control device of a copier.

The control part 201 has almost the same structure of control devices of a copier as illustrated in FIG. 5 explained later in detail. Namely, the control port 201 includes a ROM for storing a control program, a CPU for executing the control program by reading out the control program from the ROM, a RAM for tentatively storing data, a non-volatile RAM backed up by a battery, a serial communication unit, an I/O port, a real time clock for outputting a present time, and so on.

The non-volatile RAM stores communication data to be communicated between the central control apparatus 400 and the copier group 100, a plurality of device codes, a plurality of ID codes each for identifying one of the copiers from the copier group 100, a telephone number of the central control apparatus 400, data of recalling times in a case a communication error occurs between the data communication apparatus 200 and the central control apparatus 400, data of an interval of recalling made by the data communication apparatus 200, and so on.

Hereinbelow, functions of the consumable item supplying system are summarily explained. The system basically has three functions described below. As a first function, the system communicates instruction data from the central control apparatus 400 to the copier group 100. As a second function, the system communicates request data and alarm data from the copier group 100 to the central control apparatus 400 through the data communication apparatus 200. As a third function, the system uniquely controls the data communication apparatus 200.

According to the first function of the system, the following communication is executed. Firstly, total copying counts counted by a predetermined copier of the copier group 100, copying counts for each of copysheet cassettes disposed in the copiers 100-1 to 100-5, copying counts for each of different sized copysheets used in the copiers 100-1 to 100-5, total times of miss-feedings occurring in any of copysheet feeding paths of the copiers 100-1 to 100-5, miss-feeding times per each of the different sized copysheets of the copiers 100-1 to 100-5, times of the miss feeds occurring at a predetermined position on a copysheet feeding path of the copiers 100-1 to 100-5, and so on, are read for controlling the copiers 100-1 to 100-5 or reset during the above-described communication from the central control apparatus 400 to the copiers 100-1 to 100-5.

Secondly, a predetermined amount of voltage, current, resistance and process timing each to be set to an image forming unit, for example, a developing unit, of the copiers 100-1 to 100-5 are set or read during the above-described communication from the central control apparatus 400 to the copiers 100-1 to 100-5. Thirdly, messages are sent by return when a request or alarm data made by the copiers 100-1 to 100-5 is sent to the central control apparatus 400 during the above-described communication from the central control apparatus 400 to the copier group 100.

The above-described plurality of communications are executed by the data communication apparatus 200 by selecting a copier of the copier group 100 by selecting one of the copiers 100-1 to 100-5 designated by the central control apparatus 400 when the data communication apparatus 200 receives a frame sent from the central control apparatus 400.

Figure 3:
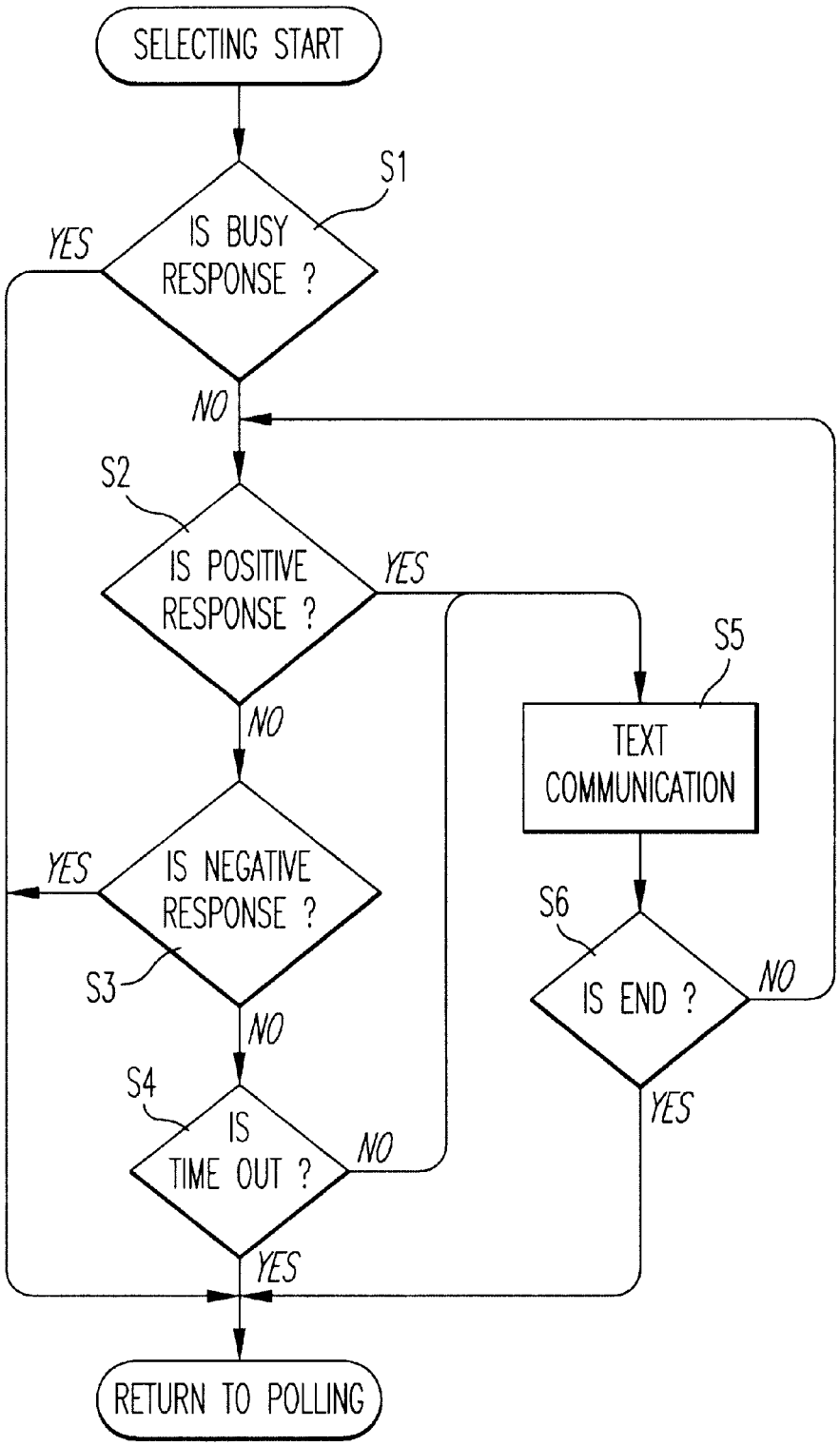
FIG. 3 is a flowchart showing a selecting procedure which is to be executed by the data communication apparatus illustrated in FIG. 2 for a predetermined copier.

The selecting control is illustrated in FIG. 3 using a flowchart. In the selecting control, a predetermined copier of the copier group 100 is selected and a communication from the central control apparatus 400 to the predetermined copier is then started. Each copier 100-1 to 100-5 of the copier group 100 has a predetermined different device code. The data communication apparatus 200 outputs data including a predetermined code indicative of a selecting control and a predetermined device code in a manner of serial communication using, e.g., a RS-485 standard to the copier group 100.

A predetermined copier 100-1 to 100-5 of the copier group 100 understands which copier is selected by comparing the device code added to the selecting code sent from the data communication apparatus 200 with a stored device code allocated to each copier to determine if there is a coincidence between the device code added to the selecting code in the communication data and the stored device code.

A copier outputs a so called busy response signal (step S-1) having a predetermined code or codes to the data communications apparatus 200, if the copier has data to be sent to the central control apparatus 400 therein. The data communications apparatus 200 stops the selecting control and instead starts a polling control described later in detail, when such a busy response signal is output.

A copier designated by the central control apparatus 400 judges whether it is possible to be selected, namely, if it is ready to receive an external data communication, if data to be sent does not exist therein. Since if the designated copier is in operation, writing of data thereof is to be prohibited. The designated copier then outputs an OK response signal (step S-2) including a predetermined code or codes therefrom to the data communication apparatus 200 to start receiving data communication from the data communication apparatus 200 (step S-5, step S-6).

The designated copier outputs an NG response signal (in step S-3) including a predetermined code or codes therefrom to the data communication apparatus 200 to stop selecting control from the data communication apparatus 200. The data communication apparatus 200 also stops selecting control if the copier designated by the central control apparatus 400 does not output either an OK response signal or an NG response signal within a predetermined time period after selecting control starts (in step S-4), in a case that an electrical power for the copier is cut, for example.

Hereinbelow, the second function of the system is explained. In the second function, data communication is made from one of the copiers 100-1 to 100-5 of the copier group 100 to the central control apparatus 400. Firstly, an urgent communication can be made from a copier of copier group 100 to the central control apparatus 400 to indicate some possibility of an accident which may occur or which has occurred in the copier causing the copier to be inoperative. Secondly, an urgent communication can be made from a copier of copier group 100 to the central control apparatus 400 to output a consumable item request, a repair request, etc., when an operator at the copier inputs a signal indicative of requesting a new consumable item or of repairing of the copier. Thirdly, an urgent communication can be made from a copier of copier group 100 to the central control apparatus 400 to inform an event that the copier counter is close to a predetermined amount. Fourthly, a non-urgent communication can be made at a designated time (e.g., once a day) from a copier of copier group 100 to the central control apparatus 400.

When some possibility of an accident which may prevent an operator from using a copier has arisen, such a possibility can be informed to the central control apparatus 400 from the copier to avoid an accident. For example, if the copy counter completes a predetermined count which corresponds to a time for parts to be exchanged, or a predetermined time of use when parts are regarded to be used up, or a predetermined maximum durable level in which a sensor does not work, etc., this information can be supplied to the central control apparatus 400. Further, the above-described designated time can be previously set by the central control apparatus 400 and data thereof is stored in the data communication apparatus 200. However, data communication can be made urgently as described above if the predetermined times of use for the portions, for example, have been completed. Fifthly, elapsing of a predetermined time start from usage of a copier can be communicated as non-urgent data communication at a designated time from the copier to the central control apparatus 400.

The above-described communications can be executed by polling from the data communication apparatus 200. Such polling is generally executed periodically from the data communication apparatus 200 to each of the copiers 100-1 to 100-5 of the copier group 100 to receive data generated by each copier, and this polling data is then sent to the central control apparatus 400.

Figure 4:
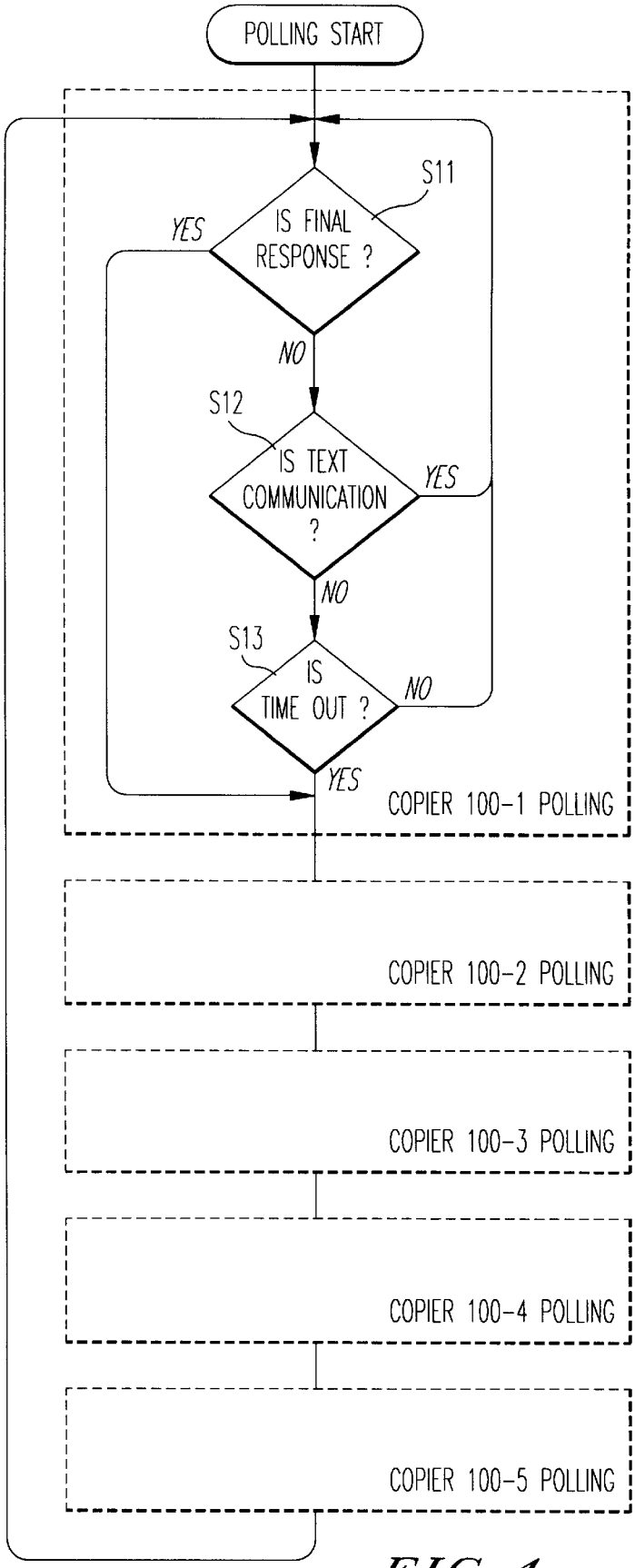
FIG. 4 is a flowchart showing a polling procedure which is to be executed by the data communication apparatus illustrated in FIG. 2 for copiers.

The polling operation from the data communications apparatus 200 is illustrated in FIG. 4 using a flowchart. The polling is executed by successively designating one of the copiers 100-1 to 100-5 and checking whether the designated copier has communication data to be sent to the central control apparatus 400 therein. As polling is executed, the data communication apparatus 200 sends predetermined code data indicative of a polling control and a device code, e.g., in a serial communication manner using a RS485 standard.

Each of the copiers 100-1 to 100-5 of the copier group 100 compares its own device code allocated to each copier and the above-described device code sent from the data communication apparatus 200 when polling. One designated of the copiers will recognize that it is designated for polling, when its own device code coincides with the device code sent from the data communications apparatus 200. The designated copier correspondingly starts outputting a code signal indicative of a consumable item request if it has such communication data to provide to the central control apparatus 400 (step S-12), and stops such data communication therefrom if no communication data exists therein or if the data communication has been completed by outputting a predetermined ending code from the designated copier.

The data communication apparatus 200 then designates a next copier of the copier group 100 to continue polling after receiving the ending code (step S-11) from the previously polled copier. Further, the data communication apparatus 200 stops polling when a predetermined time has elapsed from a start of the polling of the designated copier (see step S-13). For example, in a case that the designated copier does not return correspondence or output the ending code, for example if an electrical power is not supplied to the copier, the data communication apparatus 200 stops polling (step S-13). The polling is continuously executed to each copier of the copier group 100 in a predetermined order as long as the selecting, which may have a priority to the polling, is not started.

Hereinbelow, the third function of the system as described earlier which is executed by only the data communication apparatus 200 is explained in detail. Namely, the data communication apparatus 200 reads total counts out from designated copiers, sends data indicating whether data communication from a copier is valid by return in response to such data communication therefrom, and so on, are executed in the third function.

The above-described reading out of the total counts can be executed by selecting a designated time once a day, for example noon, for the operation. However, if an electrical power source to be supplied to the copier is off at the selected time, such reading out can be executed at a time when the electrical power source is supplied again to the designated copier.

The data communication apparatus 200 may have first and second total counter memories therein each for storing data of total counts. Such total counts can be read by a selecting control as described above and can then be stored in the first total counter memory. The data stored in the first total counter memory can be communicated when new total counts are read and stored therein on a later day unless the designated copier is not used until the day, for example Sunday, when the system generally is not used. The data stored in the first total counter memory can then be copied to the second total counter memory, e.g., at a predetermined time on a selected day once a month. The time and day are set by the central control apparatus 400 beforehand and data thereof can be stored in a non-volatile RAM disposed in the data communications apparatus 200.

The data communication apparatus 200 can send data indicating the total counts which is stored in the second total counter memory to the central control apparatus 400 by, e.g., two ways. As a first way, the central control apparatus 400 accesses the data communication apparatus 200 to read the data out at a predetermined time of day after the data of the total counts has been copied to the second total count memory. As a second way, the data communication apparatus 200 sends data of the total counts at a predetermined time of day after the data thereof has been copied to the second total counter memory to the central control apparatus 400 by automatically dialing a number of the central control apparatus 400. Time data for such a calling is also set by the central control apparatus 400 and can be stored in the non-volatile RAM of the data communication apparatus 200.

Further, the data communication apparatus 200 can have a plurality of other pairs of first and second memories. Such a plurality of first and second memories can be used for different copy modes, for example, a mono-color copying mode, a full-color copying mode, an application copying mode, such as, a facsimile mode or printer mode, and so on, to store data of total counts in each of the different copy modes in the first total counter memory and to periodically copy the stored data thereof to the second total counter memory.

Hereinbelow, a control device disposed in each of the copiers is explained in detail referring to FIG. 5. As illustrated in FIG. 5, the control device for one of the copiers of the copier group 100 is illustrated using a block chart. The control device includes a CPU 101 for executing a copying control program having an address and data, a control bus 102, a ROM 103 connected to the CPU 101 through the bus 102 for storing a control program, a RAM 104 for tentatively storing data, and a non-volatile RAM 105 for keeping data even when an electrical power source for the system is cut.

The control device further includes an I/O port 106 connected to the CPU 101 through the bus 102 for communicating data with the data communication apparatus 200. The I/O port 106 is connected with a plurality of loads, for example, a driving motor, a solenoid, a clutch, sensors, and so on (not shown), each of which are used in the copier. The control device further includes a plurality of serial communication control units 107, 108 and 109 each for sending and receiving signals from and to, respectively, an operation indicating portion, a document feeding portion and a post processing portion of the copier. The operation indicating portion is explained later in detail referring to FIGS. 8, 9 and 10. Since both the document feeding portion and the post processing portion are not new, each of these portions is not explained in detail.

The control device further includes a personal interface 110 (hereinafter referred to as a P/I) disposed between the CPU 101 and the data communication apparatus 200. Such a P/I 110 is used to reduce a load on CPU 101. The P/I 110 can be omitted if the CPU 101 has sufficient ability to cover functions to be executed by the P/I 110. Such a P/I 110 roughly has the below described plurality of functions.

Firstly, the P/I 110 watches both polling and selecting to be executed by the data communication apparatus 200. Secondly, the P/I 110 makes either an OK response or a NG response when selection is executed to the copier. Thirdly, the P/I 110 judges whether data sent between the data communication apparatus 200 and the copier 100 is correct, executes a parity check of a frame, and requests resending of the data to be sent when an error occurs in the data communication. Fourthly, the P/I 110 adjusts a header portion of the frame before sending the frame.

The control device of the copier further includes a real time clock 111 connected to the CPU 101 through the bus line 102. The CPU 101 can thereby know a real time by reading data stored in the real time clock 111.

Figure 6:
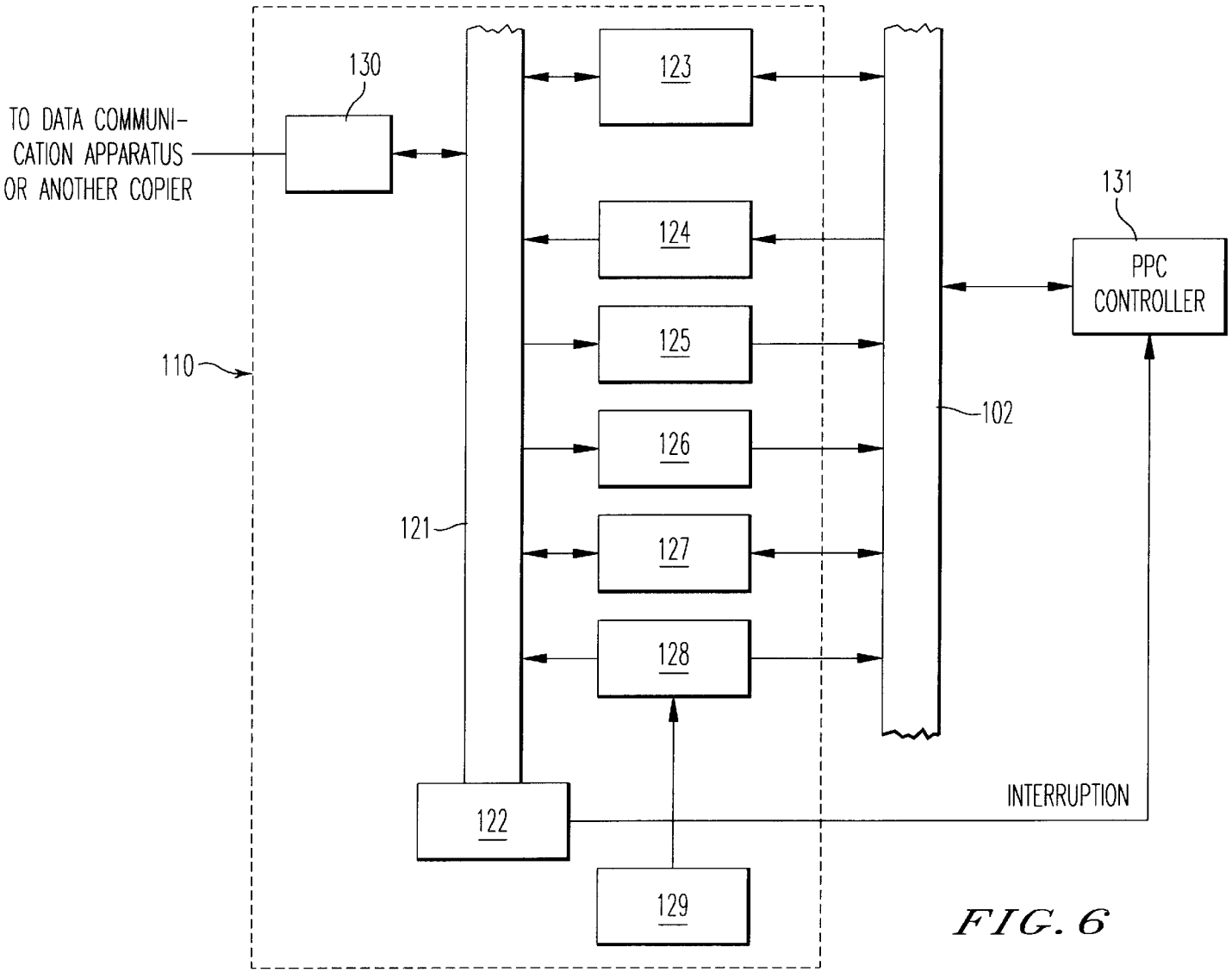
FIG. 6 shows a block chart of a P/I unit disposed in the copier control device illustrated in FIG. 5.

A control device of the P/I 110 is illustrated in FIG. 6 using a block chart. As illustrated in FIG. 6, the control device of the P/I 110 includes a ROM (not shown), a RAM (not shown), a one chip CPU 122 connected with both the ROM and RAM through a bus line 121, a dual port memory 123, a plurality of registers 124, 125, 126 and 127, an I/O port 128, and a device code setting switch 129 connected with the I/O port 128.

The dual port memory 123 can be accessed and data stored therein can be read by both the CPU 122 and CPU 101 each disposed in the P/I 110 and the copier 100. Such a dual port memory 123 is used for sending and receiving text data from and to the P/I 110 and the copier 100. The plurality of registers 124, 125, 126 and 127 are used while the text data are sent or received. Since such a plurality of registers are not new, details thereof are not explained.

A plurality of different device codes are allocated to each of the copiers. The above-described device code setting switch 129 sets such different codes for each of the copiers. As described earlier, each of the device codes is utilized when polling or selecting is executed by the data communication apparatus 200. The control device of the P/I 110 further includes a serial communication control unit 130. The serial communication control unit 130 is connected with the data communication apparatus 200 by a line and/or a P/I 110 of another copier of the copier group 100. The PPC controller 131 indicates all of the units illustrated in FIG. 5.

Hereinbelow, a structure of an operation indicating portion of a copier is explained in detail referring to several drawings, see for example FIG. 7. Such an operation indicating portion 141 includes almost the same control devices as included in the copier illustrated in FIG. 5. Namely, the operation indicating portion 141 includes a ROM for storing a control program, a CPU for executing the control program by reading the control program out from the ROM, a RAM for tentatively storing data, a serial communication unit, and an I/O port. Such an operation indicating portion 141 sends and receives data to and from the serial communication unit 107 disposed in the copier as described above.

Such an operation indicating portion 141 further includes the below described devices. A display 142 for displaying a plurality of messages therein for a plurality of copying modes is disposed on the operation indicating portion 141. A contrast amount key 143 for changing a contrast of the display 142 is disposed adjacent to the display 142. A display mode switch 155 for switching a display from a copying mode display to a consumable item request mode display when depressed is disposed adjacent to the display 142. A mode reviewing key 144 for displaying the selected modes already set to the operation indicating portion 141 on the display 142 when depressed, a menu or message changing key 145 for changing menu or messages to be displayed on the display 142 from a beginner's menu or message to an expert's menu or message when depressed, a program calling key 146 for calling a user program when depressed, a user program register key 147 for registering a user program when depressed, a guidance key 148 for displaying a guidance in the display 142, and so on, are disposed adjacent to the display 142 on the operation indicating portion 141.

Further, a print switch 149 for starting a copying operation when depressed, a ten key 150 for inputting a number of copies to made, for example, a set number clear and copy stop key 151 for either clearing preset numbers or stopping a copying operation when depressed, a confirming key 152 for confirming both a magnification set by an operator using a zoom mechanism and a margin of a copy sheet set by an operator, an interruption copy key 153 for interrupting a copying operation when depressed, and a preheat end mode clear key 154 each for pretreating a fixing roller and clearing a preset mode are disposed adjacent to the display 142 on the operation indicating portion 141.

Such a display 142 can be made of a fill dot displaying element, for example, a liquid crystal, a fluorescent material, and can include a matrix touch panel in a state of a sheet overlaid on the full dot displaying element.

Figure 8:
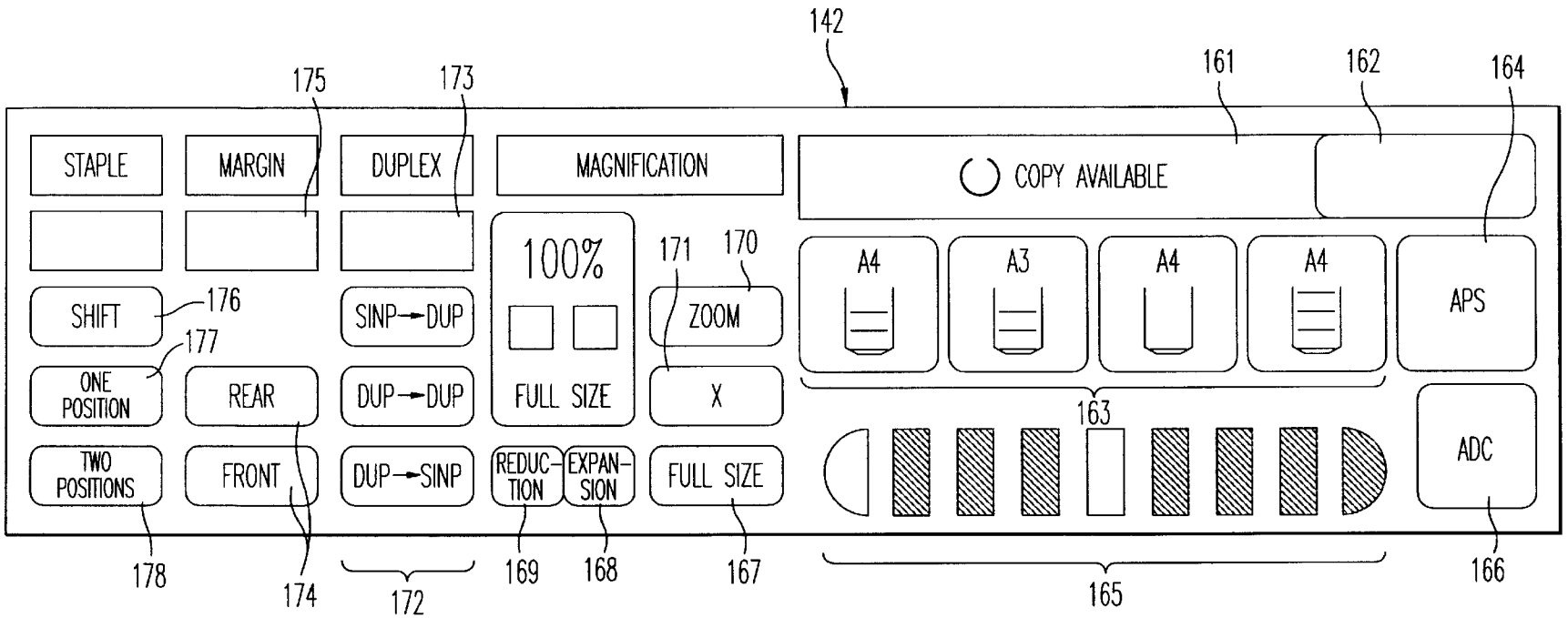
FIG. 8 shows messages to be used in a copy mode, each of which is displayed on a portion of the operation panel illustrated in FIG. 7.

Hereinbelow, the display 142 is explained in more detail referring to FIG. 8. A display for setting a plurality of copy modes is illustrated in FIG. 8. As illustrated in FIG. 8, a message display portion 161 is provided for displaying messages used in the copy mode, for example, "copy is acceptable", "replenish copy sheets", and so on. Further a copy number displaying area 162 is formed beside the message display portion 161. A copy information portion 163 which includes a plurality of tray selecting areas for selecting a desired tray from a plurality of trays, a plurality of different copysheet size displaying areas, and a plurality of remaining copysheets state display portion areas, are disposed below the message display portion 161. An auto paper selecting mode (APS mode) setting key 164 is provided for automatically selecting a copysheet having a predetermined size corresponding to a document size and/or a magnification when depressed.

Further, a density adjusting key area 165 for manually setting a desired density for the operation indicating portion 141 by touching thereof is formed below the copy information portion 163. An auto density control key area 166 for automatically setting a predetermined density range referring to a background density level on a photo-conductor when developed (not shown) is also formed beside the density adjusting key area 165. A full-size copy setting key area 167, an enlarge key area 168, and a reduction key area 169 are formed at a side of the density adjusting area 165 for optional use when a desired variety of copies are made. A zoom magnification key area 170 for setting a magnification ranging from, e.g., 64% to 142% is also formed therein at a side of the copy information portion 163.

Further, an auto magnification setting area 171 for automatically setting a predetermined magnification to accord with the selected sized copy sheet when depressed is formed below the zoom magnification area 170. A duplex copying mode selecting area 172 for setting one of duplex modes is also provided. Such duplex modes can include a first duplex copying mode in which a duplex copy is made from a duplex document and a second duplex copying mode in which a simplex copy is made from a duplex document. A duplex copying mode message area 173 for displaying the selected duplex mode with an icon indicative thereof is formed above the duplex copying mode selecting area 172.

Further, a margin setting area 174 is formed therein at a side of the duplex copying mode selecting area 172. Such a margin setting area 174 allows setting a margin from 0 mm to 21 mm at an edge of the copysheet. When the margin setting area 174 is depressed to set a margin, the margin of the copysheet set is displayed on a data margin displaying area 175 in the display 141. Further, a shift function selecting area 176, a one-position stapling key 177, and a two-position staple area 175, are also provided.

Hereinbelow, a frame to be communicated between the central control apparatus 400 and the data communication apparatus 200 is explained in detail referring to the figures. Firstly, a structure of one of a first type frame is explained referring to FIG. 9. A plurality of the first type frames are generally communicated therebetween and accordingly a plurality of sequential numbers are put thereto. Therefore, each of the sequential numbers represents a communication frame number. Namely, a number "01" is put on the first frame, and increased numbers are put on the following frames. Such numbers can increase until "99" and can end at "00".

The frame has text data therein including an ID code, a distinction code, and an information record. The ID code identifies both the data communication apparatus 200 and one of the copiers 100-1 to 100-5. The distinction code includes a code for indicating an object of a communication (hereinafter referred to as a processing code), a senders code, and a recipient code. Such a distinction code can be predetermined referring to a table as illustrated in FIG. 22. The information record includes an information code, a data portion, and a digit portion indicating a digit of the data of the data portion. The information record can be predetermined referring to a table as illustrated in FIG. 23. A plurality of semicolons as data separators are inserted among the ID code, the distinction code, and the information record.

Figure 10:
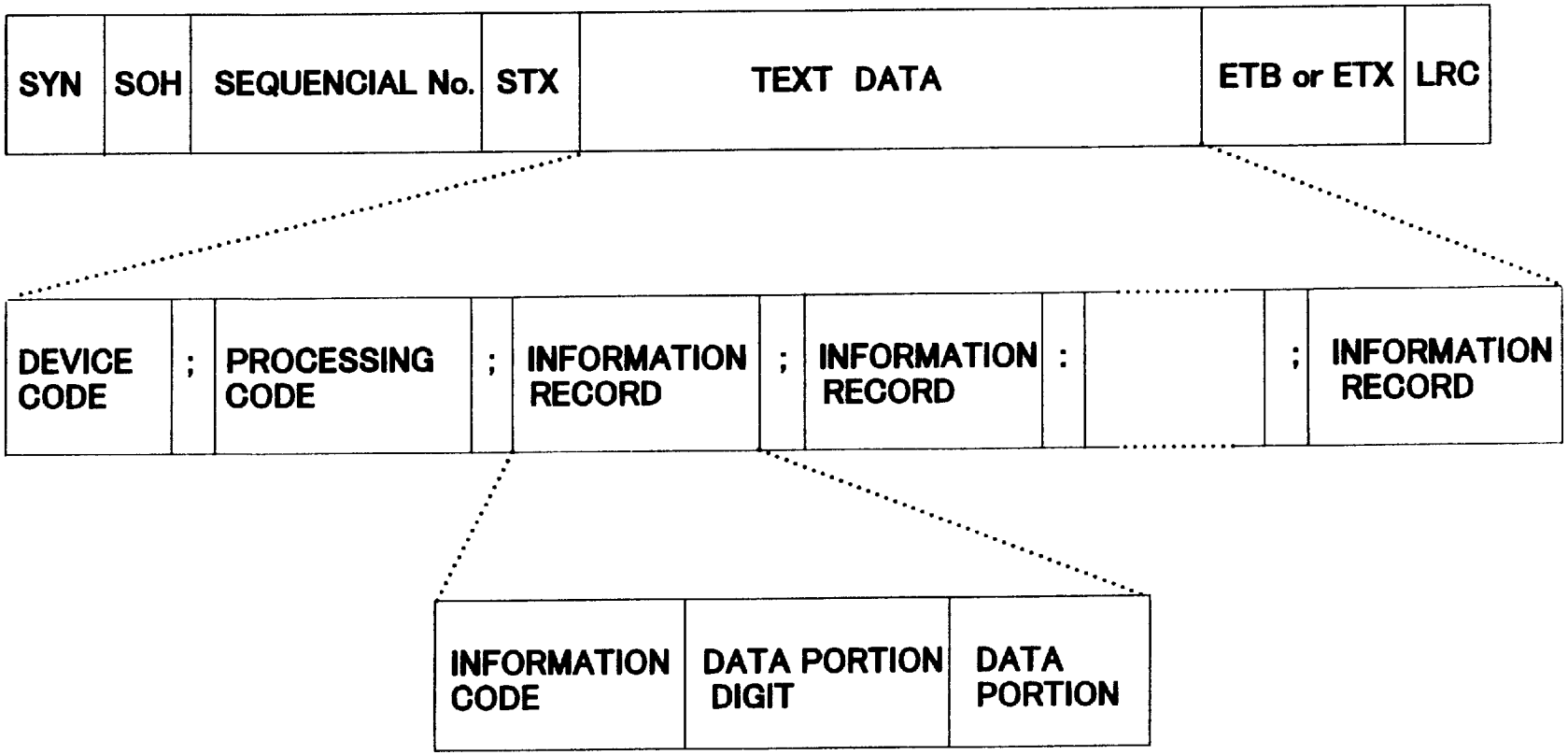
FIG. 10 is a chart explaining contents of a text to be communicated between a P/I unit and a data communication apparatus.

A second type frame which is to be communicated between the data communication apparatus 200 and the P/I 110 of each copier is illustrated in FIG. 10. A device code for identifying a communication desired device is put in this frame. On the other hand, as described earlier, a plurality of device codes set by an operator using the device code setting switch 129 illustrated in FIG. 6 are respectively read from each of the copiers 100-1 to 100-5 and are respectively stored in the non-volatile RAM of the data communication apparatus 200. The device codes stored in the non-volatile RAM are selectively converted corresponding to a sending direction of the frame.

Figure 9:
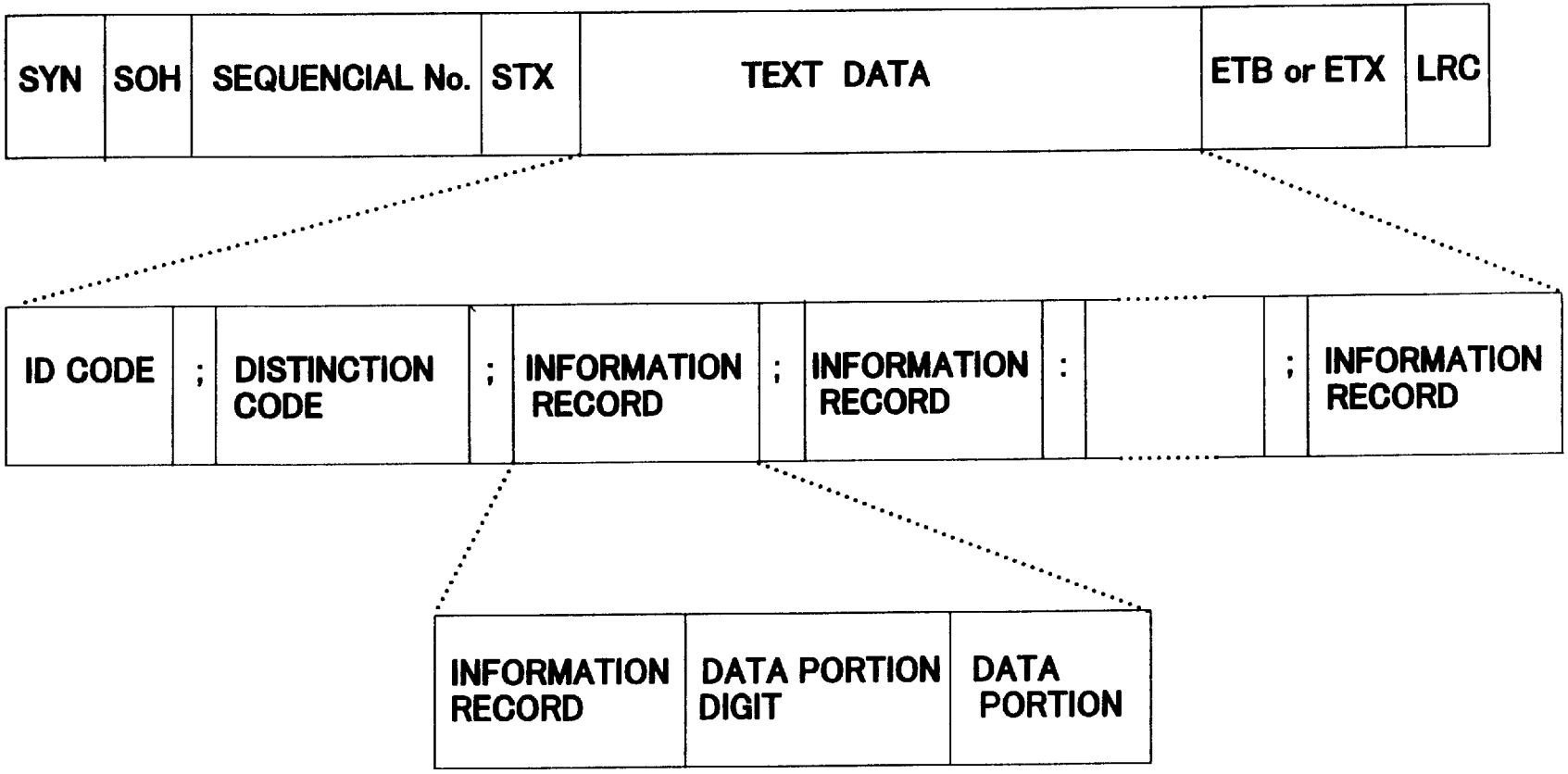
FIG. 9 is a chart explaining a structure of a frame to be communicated between a central control apparatus and a data communication apparatus.

The processing code put in the frame represents a kind of an object of the communication as described above and is constructed by deleting both senders and recipient codes from the distinction code illustrated in FIG. 9. Such codes are selectively put and deleted therefrom depending on a sending direction of the frame.

Figure 11:
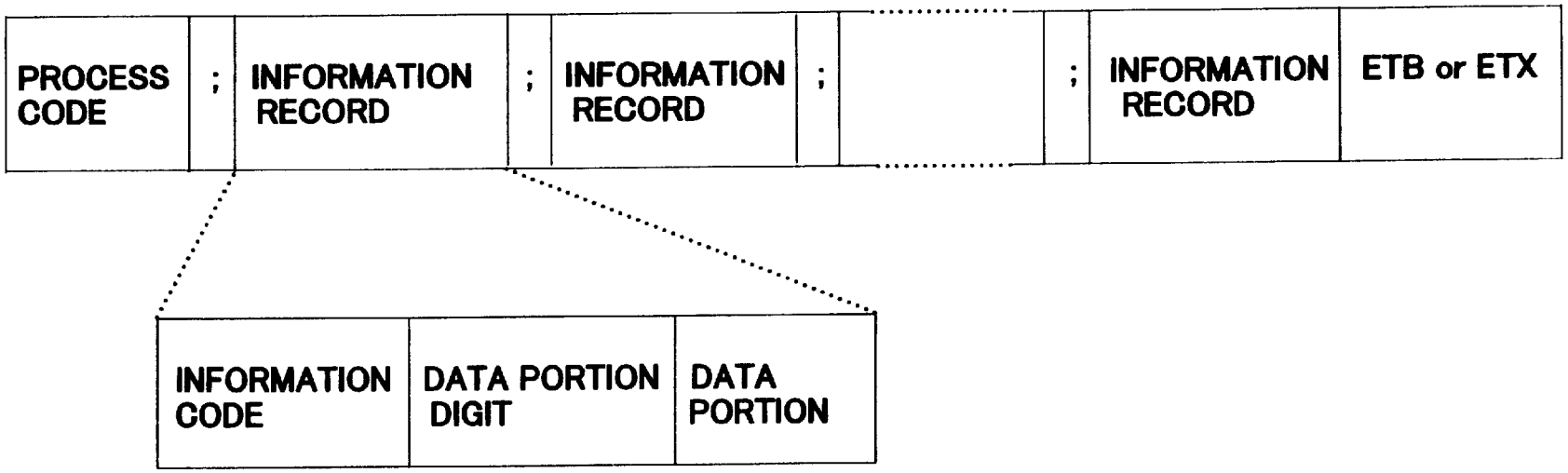
FIG. 11 is a chart explaining a structure of a frame to be communicated between a P/I unit and a copier.

A third type frame which is to be communicated between the P/I 110 and each copier is illustrated in FIG. 11. The third type text is constructed by deleting the header, the device code, and a parity portion as generally used in the second type frame illustrated in FIG. 10.

Hereinbelow, an operation of one of the embodiments of the present invention is explained in detail. A consumable item request display is illustrated in FIG. 12 through FIG. 19. When a consumable item request switch area 155 disposed above a display 142 disposed in an operation indicating portion 141 as illustrated in FIG. 7 is depressed by an operator, messages presently displayed in the display 142 as illustrated in FIG. 8 for a copying mode change to a consumable item request mode as illustrated FIG. 12. If the consumable item request switch area 155 is then depressed once more, the messages displayed thereon changes to return to the previous messages as illustrated in FIG. 8.

Figure 12:
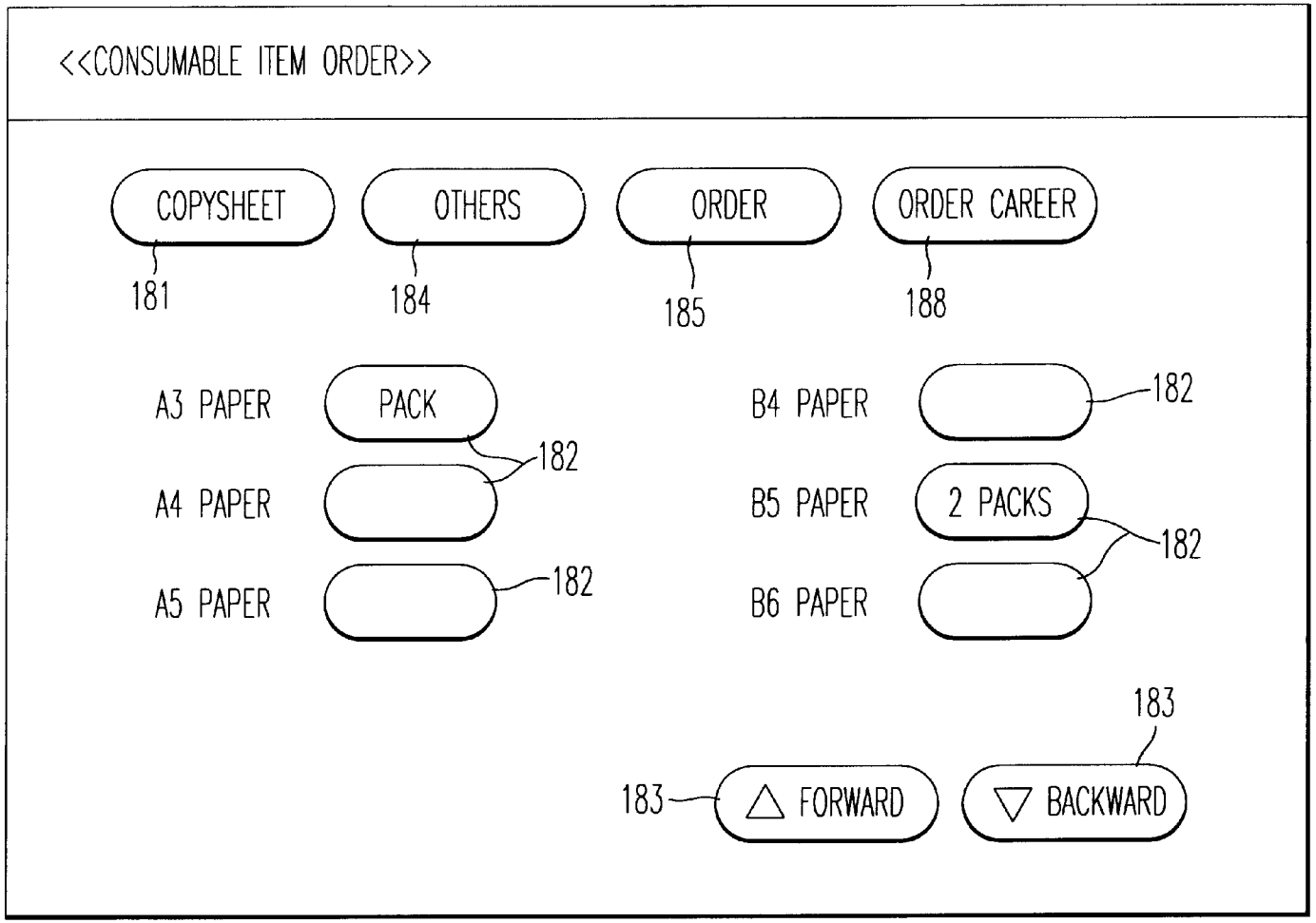
FIG. 12 shows messages to be displayed on a display of an operation panel when a copysheet is requested.
Figure 13:
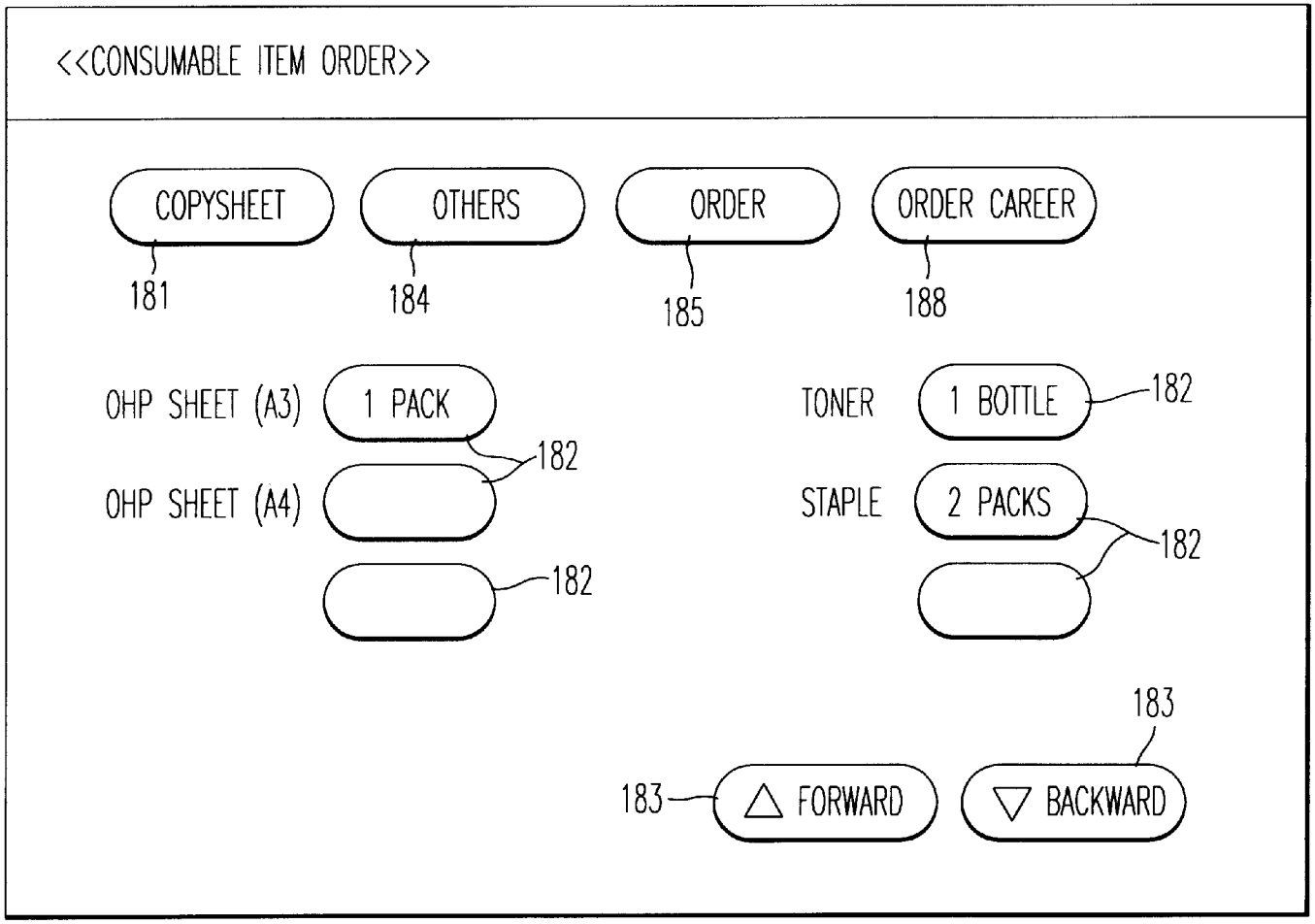
FIG. 13 shows messages to be displayed on a display of an operation panel when a consumable item without a copysheet is requested.

When the operator depresses a copysheet input area 181, a variety of copysheet size messages and an amount setting area 182 appear below the copysheet input area 181 as illustrated in FIG. 12. When the operator depresses one of the amount setting area 182 indicating a desired copysheet size, for example an A3 sized copysheet, a display condition of the amount setting area turns to a different appearance. For example, the area changes color from light to dark to indicate that the operator can input an amount of desired copysheets as a consumable item request.

Figure 7:
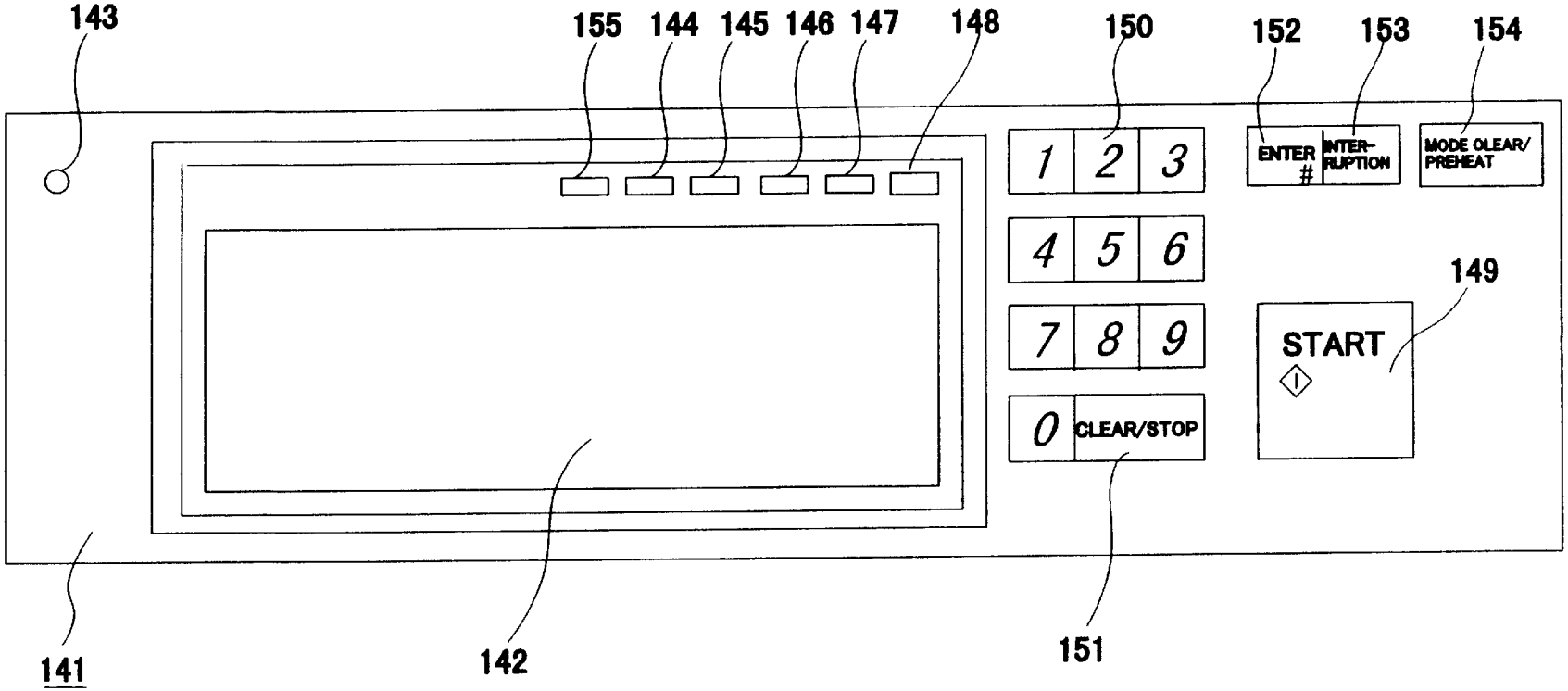
FIG. 7 is a plane view showing an operation panel of a copier.

Such an amount can be input by the operator using the ten keys 150 illustrated in FIG. 7 and can be fixed when an enter key area 152 illustrated in FIG. 7 is then depressed. The fixed amount can be cleared by depressing the clear and stop key 151, when the operator erroneously inputs the amount. The variety of copysheet size messages and amount setting area 182 can be scralled downward by depressing a scrall key area 183 when another size copysheet is desired.

Another consumable item setting key area 184 for requesting another consumable item, for example, OHP sheets, toner, staples, and so on, is provided beside the copysheet input area 181 as illustrated in FIG. 12. When such a key 184 is depressed, a variety of copysheet size messages and an amount setting area 182 presently displayed changes to other messages as illustrated in FIG. 13 through FIG. 17. Since the same operation as described above is executed for such a consumable item request, a detailed explanation is omitted here.

Figure 14:
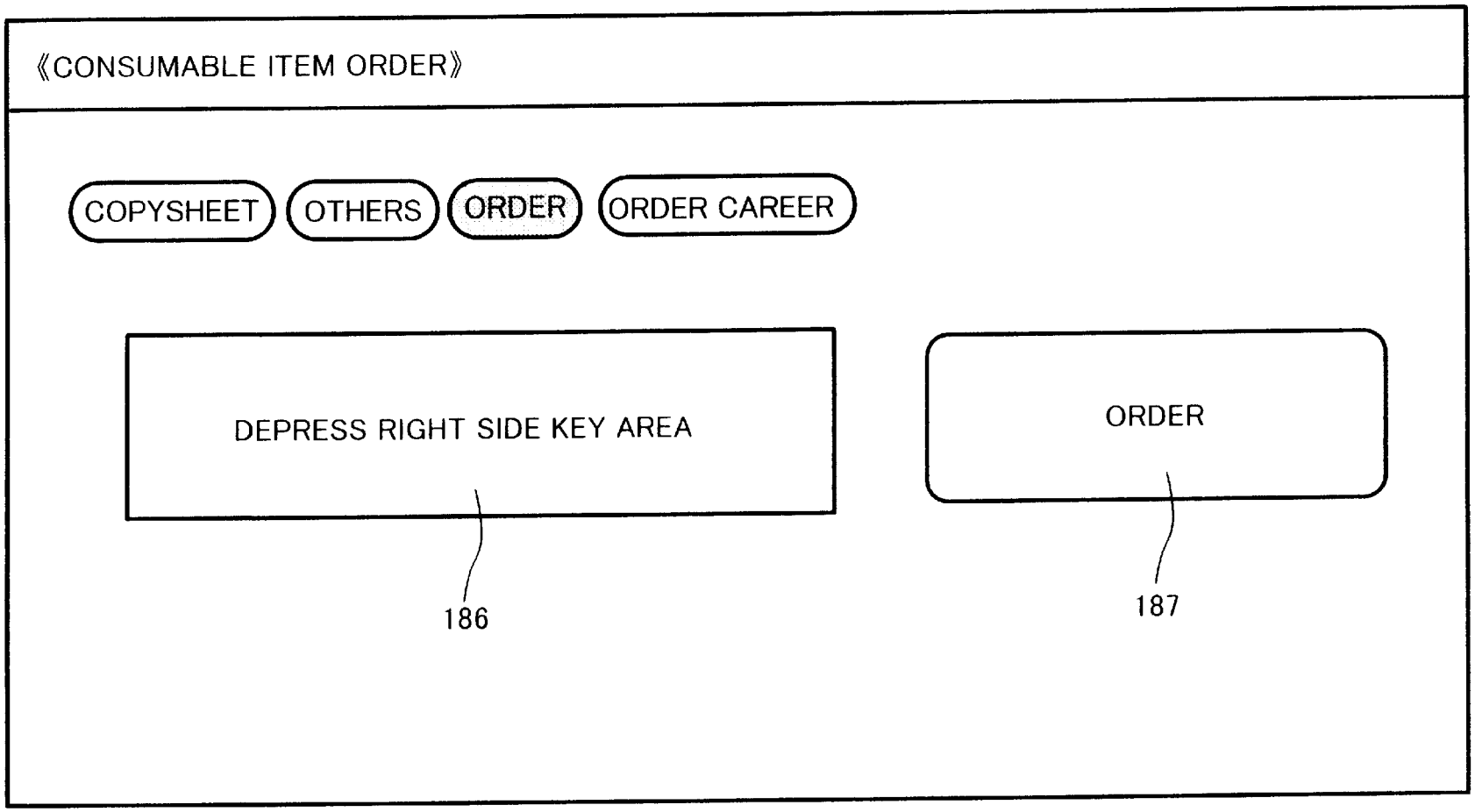
FIG. 14 shows messages to be displayed on a display of an operation panel when other consumable items are requested from a copier.

A consumable item order display switch area 185 is provided beside the another consumable item setting key area 184 as illustrated in FIG. 12 for changing the display from a previous display to a new display as illustrated in FIG. 14 through FIG. 17 when depressed. As illustrated in FIG. 14, a warning message area 186 and a consumable item request key area 187 then appear on the display.

Figure 15:
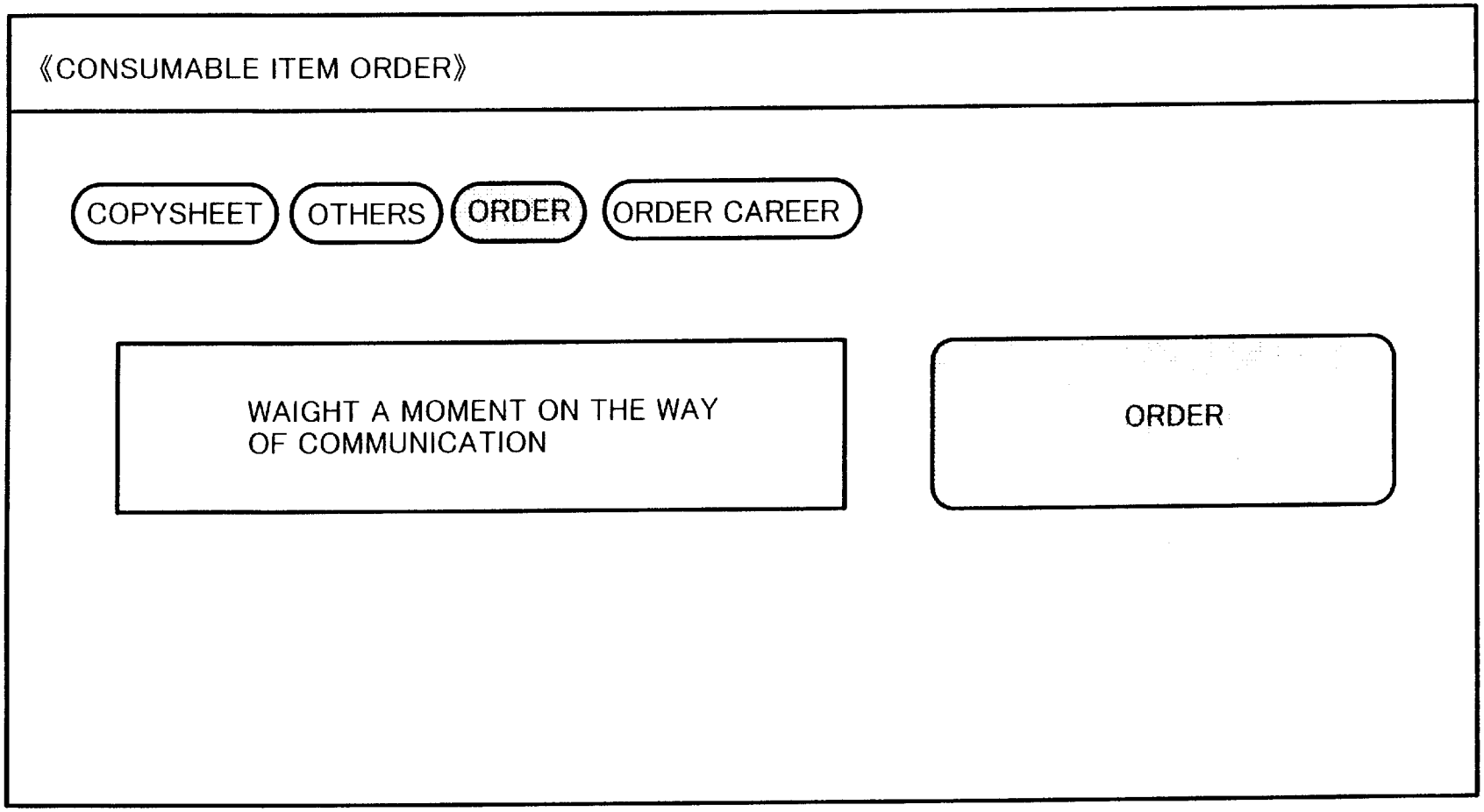
FIG. 15 shows messages to be displayed on a display of an operation panel during a communication of a consumable items request.
Figure 16:
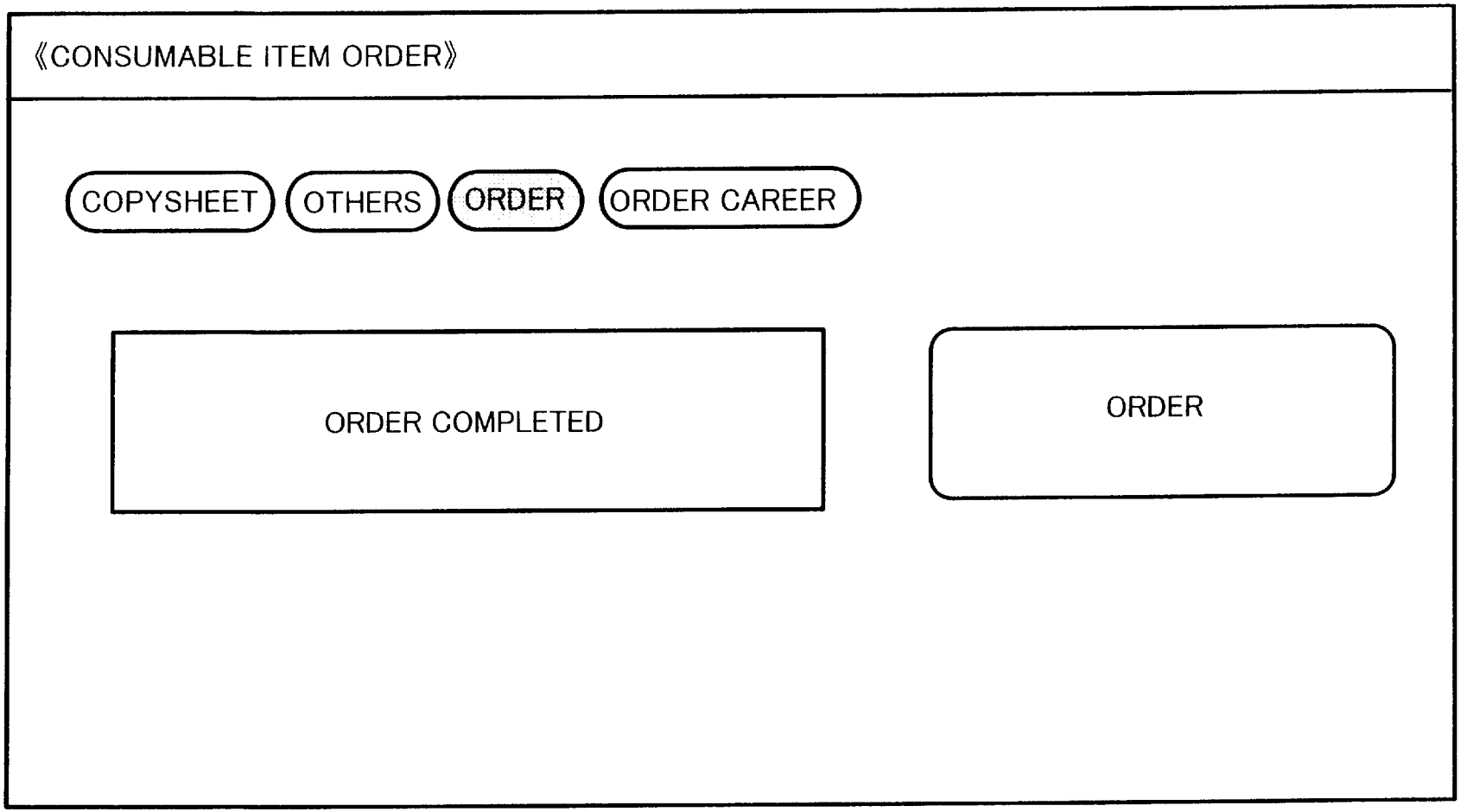
FIG. 16 shows messages to be displayed on a display of an operation panel when communication of data representing consumable items requested between a data communication apparatus and a central control apparatus are successfully made.
Figure 17:
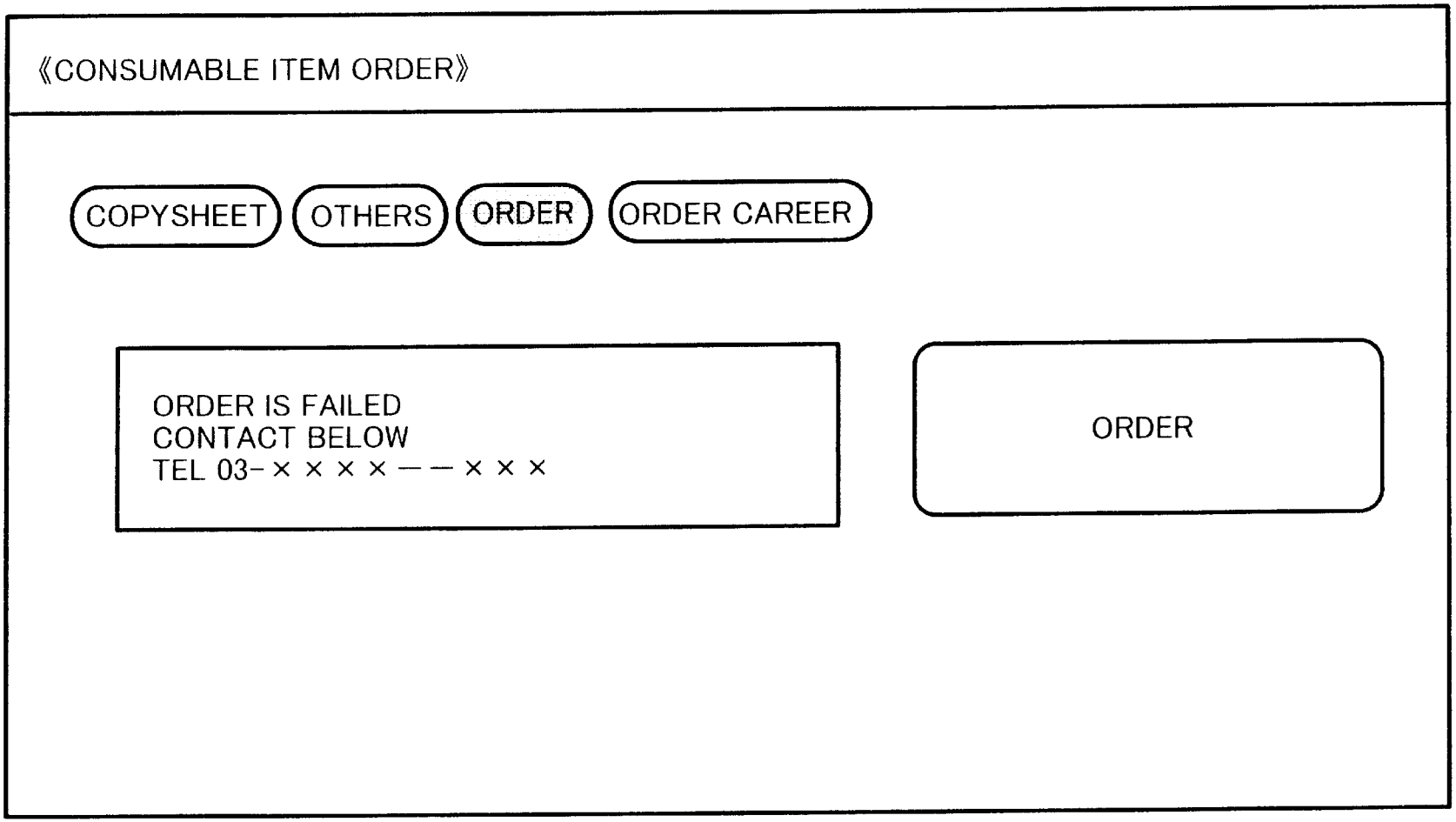
FIG. 17 shows messages to be displayed on a display of an operation panel when communication of data representing consumable items requested between a data communication apparatus and a central control apparatus result in a failure.

If such a consumable item request has not yet been communicated from the copier to the central control apparatus 400, a warning massage illustrated in FIG. 14 is displayed to make a warning to the operator. Namely, some messages, for example, "please depress a right side key area if you request a consumable item" are displayed. If the operator then depresses a consumable item request key area 187, a data of the consumable item requested is communicated from the copier to the central control apparatus 400. A message as illustrated in FIG. 15 can be displayed during the above-described data communicating operation to inform the operator to await for a status of the communication. If such a communication operation in successful, messages indicating success are displayed as illustrated in FIG. 16. To the contrary, if the communication is unsuccessful, messages indicating a failure are displayed as illustrated in FIG. 17.

Hereinbelow, some data to be communicated from one of the copiers 100-1 to 100-5 of the copier group 100 is explained in detail referring to FIG. 20. Such data includes a process (A) code representing a consumable item order, an information code (B) representing a call for the consumable item order, and an information code (C) representing an amount of the consumable item and kind thereof requested by the operator. In this embodiment of the present invention, data for a consumable item not requested is represented by information code "0". However, such an information code for a consumable item can be used only when the consumable item is actually requested with some amount. Further, another information code can be optionally added to the data as additional data.

The above-described data communication from the copiers 100-1 to 100-5 to the central control apparatus 400 can also be executed by polling under control of the data communication apparatus 200 as explained earlier referring to FIG. 4. Namely, a designated copier of the copier group 100 starts a data communication with the data communication apparatus 200 when the designated copier is polled.

Figure 18:
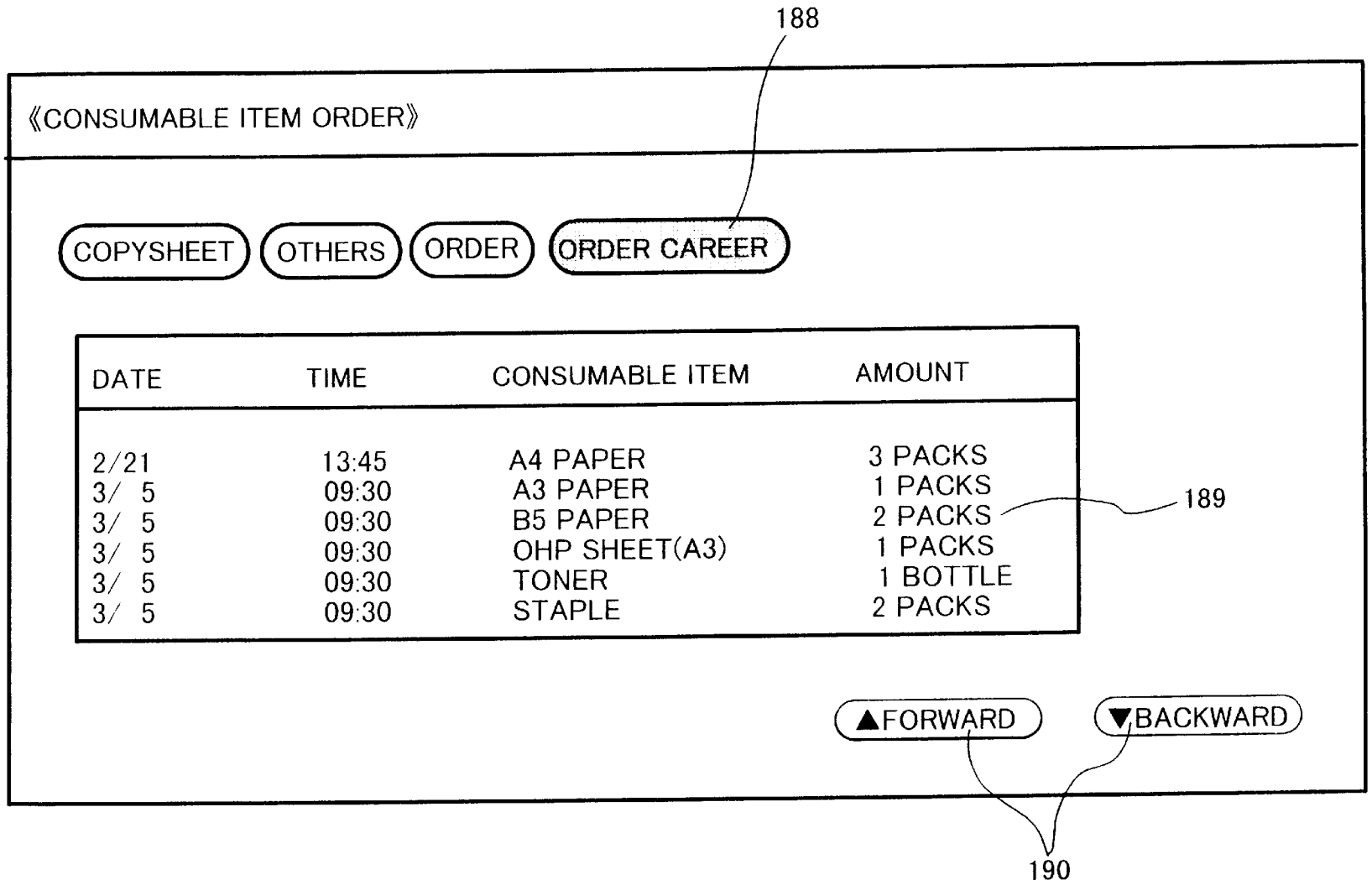
FIG. 18 shows messages to be displayed on a display showing a career of consumable items having been requested from one image forming apparatus and which are not yet delivered.

When a data communication from the designated copier to the central control apparatus 400 through the polling of the data communication apparatus 200 is successful, the copier reads a present date and a time from the real time clock 111 and stores such data in the non-volatile RAM 105. The copier also stores data indicating a kind of the consumable item requested and an amount requested in the non-volatile RAM 105 as a career record of a consumable item request. Such a career record can be displayed on the display 181 when the operator depresses a request career key area 188 as illustrated in FIG. 18. Namely, the career data stored in the non-volatile ROM 105 is displayed on a consumable item request carrier display portion 189. A consumable item request career display scrall key 190 is provided and messages of the consumable item request career can be scrall by depressing such a key area 190 when all of the messages cannot be displayed at one time.

Hereinbelow, management of the central control apparatus 400 to be made in response to the consumable item request is explained in detail. When data communication for a consumable item request from a copier of copier group 100 to the central control apparatus 400 is successful, the central control apparatus 400 orders the consumable item in accordance with the request data to a consumable item supplier or the like which then delivers the consumable item to the user. The central control apparatus 400 at same time can determine a schedule of an expected delivery day for delivery after referring to a delivery condition of the consumable item supplier or the like. The central control apparatus 400 can then send such information data of the expected delivery date in a state of a data format illustrated in FIG. 21. Such data includes a process code (A) representing that data is to be written into the copier from the central control apparatus 400, an information code (B) representing an expected delivery date for the requested consumable item, and an executed delivery date.

Figure 19:
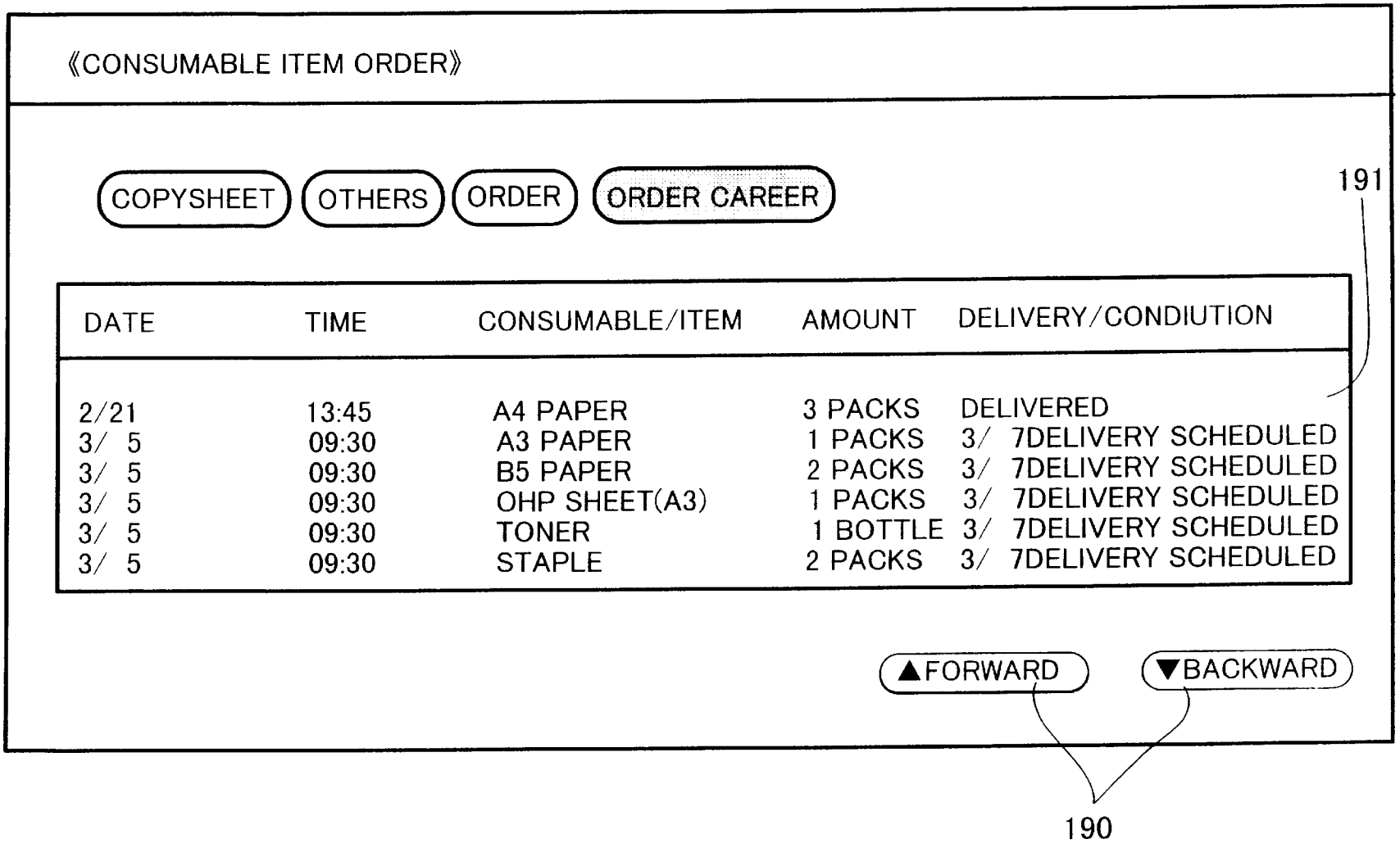
FIG. 19 shows messages showing a status of a delivery corresponding to requests of consumable items.

The above-described date communication from the central control apparatus 400 to a copier of copier group 100 is executed by selecting from the data communication apparatus 200 as explained earlier referring to FIG. 3. The copier controls the display 181 to display the expected delivery date and the consumable item request carrier record on a request carrier and a delivery condition displaying area 191 formed in the display 181 as illustrated in FIG. 19 when the data is received from the central control apparatus 400.

The above-described expected schedule for delivery of the requested consumable item can be automatically determined by the central control apparatus 400 or manually determined by a person in charge of delivery by referring to a delivery condition of the consumable item supplier or the like.

Of course, numerous additional modifications and variations of the present invention are possible in light of the above teachings. It is therefore to be understood that within the scope of the appended claims, the present invention may be practiced otherwise than as specifically described herein.

The present application is based on Japanese Priority Document JPAPO9-125689, the contents of which are incorporated herein by reference.

What is claimed is:

1. A consumable item supplying system comprising:

a plurality of image forming apparatus, each image forming apparatus using at least one consumable item:

each image forming apparatus including consumable item manual inputting means for manually inputting consumable item information, including at least one of a type and an amount of consumable items to be ordered;

central control means for sending data to each of said plurality of image forming apparatus by a polling operation and for receiving data from each of said image forming apparatus corresponding to respective of said input consumable item information, and further for ordering said consumable items based on said input consumable item information; and data communication means for communicating data representing said consumable item information from each of said plurality of image forming apparatus to said central control means.

2. A consumable item supplying system as claimed in claim 1, further comprising:

a memory means disposed in said image forming apparatus for storing said consumable item information input to said image forming apparatus.

3. A consumable item supplying system as claimed in claim 1, further comprising:

a delivery schedule informing means for informing a delivery schedule of said at least one consumable item to said image forming apparatus.

4. A consumable item supplying system as claimed in claim 1, further comprising:

a delivery status informing means for informing a delivery status of said at least one consumable item to said image forming apparatus.

5. A consumable item supplying system as claimed in claim 3, further comprising:

a display means provided in said image forming apparatus for displaying said delivery schedule of said at least one consumable item.

6. A consumable item supplying system as claimed in claim 4, further comprising:

a display means provided in said image forming apparatus for displaying said delivery status of said at least one consumable item.

7. A consumable item supplying system as claimed in claim 2, further comprising:

a display means provided in said image forming apparatus for displaying a career of consumable item requests when requested by an operator.

8. A consumable item supplying system comprising:

a plurality of image forming apparatus, each image forming apparatus using at least one consumable item;

each image forming apparatus including a display input for manually inputting consumable item information, including at least one of a type and an amount of consumable items to be ordered;

a data communication apparatus which sends data to each of said plurality of image forming apparatus by a polling operation, which receives data from each of said image forming apparatus corresponding to respective of said input consumable item information, which receives data of said input consumable item information from each of said plurality of image forming apparatus, and which communicates said data of said input consumable item information to a central controller.

9. A consumable item supplying system as claimed in claim 8, wherein said data communication apparatus includes a polling and selecting means each for receiving said data from said image forming apparatus and sending said data from said data communication apparatus to said central controller.

10. A consumable item supplying system as claimed in claim 8, wherein said display displays messages of consumable item kinds and an amount thereof and generates data related to said consumable item kinds and amount when depressed.

11. A consumable item supplying system as claimed in claim 10, wherein said display displays messages of a plurality of copying modes.

12. A consumable item supplying system as claimed in claim 10, further comprising:

an input mode switch to change said message including consumable item input messages.

13. A consumable item supplying system comprising:

a plurality of image forming apparatus, each image forming apparatus using at least one consumable item;

each image forming apparatus including a display input for manually inputting consumable item information, including at least one of a type and an amount of consumable items to be ordered;

a central controller which sends data to each of said plurality of image forming apparatus by a polling operation, which receives data from each of said image forming apparatus corresponding to respective of said input consumable item information, which receives data of said input consumable item information from each of said plurality of image forming apparatus, and which orders supplying said at least one consumable item based on said received consumable item information.

14. A consumable item supplying system as claimed in claim 13, further comprising a data communication apparatus which polls said at least one image forming apparatus to obtain the input consumable item information and which communicates the consumable item information to the central controller.

15. A consumable item supplying system as claimed in claim 13, wherein said display displays messages of consumable item kinds and an amount thereof and generates data related to said consumable item kinds and amount when depressed.

16. A consumable item supplying system as claimed in claim 15, wherein said display displays messages of a plurality of copying modes.

17. A consumable item supplying system as claimed in claim 15, further comprising:

an input mode switch to change said message including consumable item input messages.

18. A consumable item supplying method, comprising steps of:

manually inputting consumable item data, including at least one of a type and an amount of consumable items to be ordered, to an image forming apparatus of a plurality of image forming apparatus;

polling each of said plurality of image forming apparatus to obtain said manually input consumable item data;

communicating said consumable item data to a central control device; and ordering a consumable item corresponding to said communicated consumable item data.

19. A consumable item supplying method as claimed in claim 18, further comprising a step of:

storing said consumable item data, and displaying said consumable item data on a display of said image forming apparatus.

20. A consumable item supplying method as claimed in claim 18, further comprising steps of:

communicating data representing a delivery schedule and delivery status from said central control device to said image forming apparatus; and displaying each of said delivery schedule and delivery status on said display of said image forming apparatus.

21. A consumable item supplying system comprising:

an image forming apparatus using at least one consumable item;

consumable item manual inputting means for manually inputting consumable item information to said image forming apparatus;

central control means for ordering said consumable items based on said input consumable item information;

data communication means for communicating data representing said consumable item information from said image forming apparatus to said central control means;

a memory means disposed in said image forming apparatus for storing said consumable item information input to said image forming apparatus; and a display means provided in said image forming apparatus for displaying a career of consumable item requests when requested by an operator.

22. A consumable items supplying system as claimed in claim 21, further comprising:

a delivery schedule informing means for informing a delivery schedule of said at least one consumable item to said image forming apparatus.

23. A consumable item supplying system as claimed in claim 21, further comprising:

a delivery status informing means for informing a delivery status of said at least one consumable item to said image forming apparatus.

24. A consumable item supplying system as claimed in claim 22, further comprising:

a display means provided in said image forming apparatus for displaying said delivery schedule of said at least one consumable item.

25. A consumable item supplying system as claimed in claim 23, further comprising:

a display means provided in said image forming apparatus for displaying said delivery status of said at least one consumable item.

* * * * *